US007890029B2

(12) United States Patent
Hamada

(10) Patent No.: US 7,890,029 B2
(45) Date of Patent: Feb. 15, 2011

(54) IMAGE FORMING APPARATUS

(75) Inventor: Toshimasa Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 57 days.

(21) Appl. No.: 12/481,845

(22) Filed: Jun. 10, 2009

(65) Prior Publication Data

US 2009/0304414 A1 Dec. 10, 2009

(30) Foreign Application Priority Data

Jun. 10, 2008 (JP) ..... P2008-152291
Jan. 23, 2009 (JP) ..... P2009-013575

(51) Int. Cl.
*G03G 15/09* (2006.01)

(52) U.S. Cl. ..... 399/270; 399/53; 399/55

(58) Field of Classification Search ..... 399/38, 399/53–55, 252, 265, 270
See application file for complete search history.

(56) References Cited

U.S. PATENT DOCUMENTS

| | | | | |
|---|---|---|---|---|
| 5,669,050 | A | 9/1997 | Sakemi et al. | |
| 5,999,782 | A * | 12/1999 | Iguchi et al. | 399/270 |
| 6,049,687 | A * | 4/2000 | Hibino et al. | 399/270 |
| 6,163,663 | A | 12/2000 | Shinohara et al. | |
| 6,512,909 | B2 * | 1/2003 | Ozawa et al. | 399/270 |
| 6,829,447 | B2 | 12/2004 | Okano et al. | |
| 7,043,175 | B2 * | 5/2006 | Komoto et al. | 399/159 |

FOREIGN PATENT DOCUMENTS

| | | |
|---|---|---|
| JP | 55-101969 A | 8/1980 |
| JP | 7-311497 | 11/1995 |
| JP | 11-44985 | 2/1999 |
| JP | 11-109732 A | 4/1999 |
| JP | 2000-231247 | 8/2000 |
| JP | 2002-182457 | 6/2002 |
| JP | 2003-280340 A | 10/2003 |
| JP | 2006-227525 A | 8/2006 |
| JP | 2007-114317 A | 5/2007 |
| JP | 2008-164878 | 7/2008 |

* cited by examiner

*Primary Examiner*—Hoan Tran
(74) *Attorney, Agent, or Firm*—Nixon & Vanderhye, P.C.

(57) ABSTRACT

There is provided an image forming apparatus capable of realizing improvement of an image density by improving dot reproducibility and reducing fog at the same time. An alternating voltage is applied to a development sleeve so that a first period during which a first peak-to-peak voltage Vpp(1) is applied and a second period during which a second peak-to-peak voltage Vpp(2) that is lower than the first peak-to-peak voltage is applied are repeated alternately. The alternating voltage to be applied is applied so that a development-side potential to move toner from the development sleeve to a photoreceptor and an opposite development-side potential to move toner from the photoreceptor to the development sleeve alternate with each other. The potential to be finally applied in the first period is preferably the development-side potential.

13 Claims, 15 Drawing Sheets

IMAGE FORMING APPARATUS

CROSS-REFERENCE TO RELATED APPLICATION

This application claims priority to Japanese Patent Application Nos. 2008-152291 and 2009-013575, which were filed on Jun. 10, 2008 and Jan. 23, 2009, respectively, the contents of which are incorporated herein by reference in its entirety.

BACKGROUND OF THE INVENTION

1. Field of the Invention

The present invention relates to an image forming apparatus for applying an alternating voltage superimposed on a direct current voltage to a developer bearing member to thereby develop an electrostatic latent image formed on an electrostatic latent image bearing member with a toner.

2. Description of the Related Art

In an electrophotographic image forming apparatus, a development method has been employed in which the surface of an electrostatic latent image bearing member (for example, a photoreceptor) is charged and an image is exposed to the charged region to from an electrostatic latent image, and the electrostatic latent image is developed so as to be made visible (developing).

As such a development method, a development method has been commonly used in which, using one-component developer containing a toner or two-component developer containing a carrier and a toner, by frictionally charging the toner so that the toner is attracted with an electrostatic force of an electrostatic latent image on the surface of the electrostatic latent image bearing member, the electrostatic latent image is developed to thereby form a toner image.

For example, when two-component developer is used, a method has been employed, in which a magnetic brush by carrier is formed on a developer bearing member (for example, a developing roller) in a developing device, and an electrostatic latent image is developed while applying a bias voltage between the developer bearing member and an electrostatic latent image bearing member.

Moreover, whether one-component or two-component developer is used, there is a case where development is performed using a toner that is charged with a polarity opposite to a surface potential of the charged electrostatic latent image bearing member, or a case where reversal development is performed using a toner that is charged with a polarity the same as the surface potential of the charged electrostatic latent image bearing member.

In addition, there is also a case where an electrostatic latent image that is formed on the electrostatic latent image bearing member is developed with the toner by applying an oscillating bias voltage between the developer bearing member and the electrostatic latent image bearing member. In this oscillating bias voltage, a development-side electrical potential, i.e., a for-development electrical potential, that can apply a force to the charged toner in the direction from the developer bearing member toward the electrostatic latent image bearing member and an opposite development-side electrical potential, i.e., an against-development electrical potentials that can apply a force to the toner in the direction from the electrostatic latent image bearing member to the developer bearing member alternate with each other, and for example, as shown in FIG. 9, a rectangular wave is commonly used whose ratio (duty ratio) of the application time during which the development-side electrical potential is applied to the application time or a cycle during which the development-side electrical potential and the opposite development-side electrical potential are applied is 50%.

Incidentally, in such a conventional development method, it is desirable that the charge amount of the toner is increased to obtain smooth image quality with little roughness. However, for example, when two-component developer is used, the electrostatic force between a carrier and a toner is in proportion to she square of the charge amount, thus, when the charge amount of the toner is increased, a rate that the carrier separates from the toner decreases. Accordingly, the utilization efficiency of the toner consequently deteriorates and the image density is reduced. In order to increase the image density, an oscillation amplitude voltage Vpp (peak-to-peak voltage) of the oscillating bias voltage may be increased. However, when Vpp is increased, an electric field in the direction where the toner returns from the electrostatic latent image bearing member to the developer bearing member is strengthened, thus a toner image that has been attached to the electrostatic latent image bearing member once is peeled off and dot is not added completely. That is, so-called dot reproducibility tends to deteriorate.

Therefore, in recent years, a configuration has been proposed that, to act an electric field with an AC electric field superimposed on a DC electric field in a developing area in which the developer bearing member and the image bearing member are opposed, development is performed by applying a developing bias voltage so as to alternately repeat a first period during which an AC voltage is acted between the developer bearing member and the image bearing member and a second period during which no AC voltage is applied, for example as shown in FIG. 10 (refer to, for example, Japanese Unexamined Patent Publication JP-A 7-311497 (1995)).

In addition, as shown in FIG. 11, a configuration has been also proposed that development is performed by slightly giving vibration at a high frequency in the second period during which no AC voltage is applied (refer to, for example, JP-A 11-44985 (1999)).

In an image forming apparatus described in the JP-A 7-311497, there is an effect that dot reproducibility is improved and unevenness in a halftone area is reduced to form a smooth image, however, a force of returning a toner from the electrostatic latent image bearing member to the developer bearing member is so weak that adhesion of the toner to a non-image area, so-called fog, is increased.

Similarly in a developing device described in the JP-A 11-44985, there is an effect that dot reproducibility is improved and unevenness in a halftone area is reduced to form a smooth image, however, a force of returning a toner from the electrostatic latent image bearing member to the developer bearing member is insufficient. An electric field is applied in a direction to return the toner from the electrostatic latent image bearing member to the developer bearing member as vibration is given in the second period, however, it is impossible to return the toner sufficiently due to a high frequency, thus increasing fog as well.

SUMMARY OF THE INVENTION

An object of the invention is to provide an image forming apparatus capable of realizing improvement of an image density by improving dot reproducibility and reducing fog at the same time.

The invention provides an image forming apparatus comprising an electrostatic latent image bearing member on which an electrostatic latent image is to be formed, and a developing device that has a developer bearing member and develops the electrostatic latent image formed on the electrostatic latent image bearing member with a toner by applying an alternating voltage superimposed on a DC voltage, to the developer bearing member, the alternating voltage to be applied having an alternating voltage waveform in which a development-side potential to move a toner from the developer bearing member to the electrostatic latent image bearing member and an opposite development-side potential to move a toner from the electrostatic latent image bearing member to the developer bearing member alternate with each other, and in the alternating voltage, a first period during which a first peak-to-peak voltage being applied and a second period during which a second peak-to-peak voltage lower than the first peak-to-peak voltage being applied are alternately repeated and a frequency f1 of the alternating voltage in the first period and a frequency f2 of the alternating voltage in the second period have a relation of f1=f2.

According to the invention, an image forming apparatus comprises an electrostatic latent image bearing member on which an electrostatic latent image is to be formed, and a developing device that has a developer bearing member and develops an electrostatic latent image formed on an electrostatic latent image bearing member with a toner by applying an alternating voltage superimposed on a DC voltage to the developer bearing member. In the image forming apparatus, the alternating voltage is applied so that a first period during which a first peak-to-peak voltage is applied and a second period during which a second peak-to-peak voltage lower than the first peak-to-peak voltage is applied are alternately repeated. In addition, a frequency f1 of the alternating voltage in the first period and a frequency f2 of the alternating voltage in the second period have a relation of f1=f2. In a case where the f1 and the f2 are different, a circuit configuration for applying the alternating voltage becomes complicated and apparatus cost is increased, resulting that the relation of f1=f2 is preferable.

Since an image density is almost decided by a maximum peak-to-peak voltage, it is possible in the first period to obtain the same image density as in the case of continuously applying the maximum peak-to-peak voltage at all times. Meanwhile, although there is a drawback that dot reproducibility is deteriorated when the maximum peak-to-peak voltage is continuously applied at all times, dot reproducibility is improved by providing the second period. In addition, when the peak-to-peak voltage is 0 in the second period, fog is increased, however, it is possible to suppress fog by applying a constant level of peak-to-peak voltage.

Further, in the invention, it is preferable that a potential that is applied finally in the first period is the development-side potential in the alternating voltage.

According to the invention, a potential that is applied finally in the first period is the development-side potential so that a toner that has once reached a latent image on the electrostatic latent image bearing member will not be peeled off, resulting that the image density is increased and dot reproducibility is also enhanced. Meanwhile, when the potential that is applied finally in the first period is the opposite development-side potential, the image density is decreased and dot reproducibility is deteriorated.

Further, in the invention, it is preferable that a periodic number included in the first period is 2 or 3 in the alternating voltage.

According to the invention, a periodic number included in the first period is 2 or 3. Since fog is increased when the periodic number included in the first period is 1, the number is needed to be 2 or more, and since dot reproducibility is lowered in the case of being 4 or more, the number is preferably 2 or 3.

Further, in the invention, it is preferable that a periodic number included in the second period is 2 or more fin the alternating voltage.

According to the invention, a periodic number included in the second period is 2 or more. Since dot reproducibility is lowered when the periodic number included in the second period is 1, the number is preferably 2 or more.

Further, in the invention, it is preferable that the following expression is satisfied in the alternating voltage:

$$0.1 \leqq Vpp(2)/Vpp(1) \leqq 0.5,$$

where Vpp(1) denotes a peak-to-peak voltage in the first period and Vpp(2) denotes a peak-to-peak voltage in the second period.

According to the invention, $0.1 \leqq Vpp(2)/Vpp(1) \leqq 0.5$ is satisfied, where Vpp(1) denotes a peak-to-peak voltage in the first period and Vpp(2) denotes a peak-to-peak voltage in the second period.

As a value of Vpp(2) becomes smaller, a toner is easily moved to the latent image and dot reproducibility is therefore improved, however, fog is lowered when the value becomes too small, and therefore, the value preferably falls within the range.

Further, in the invention, it is preferable that a frequency f1 in the first period is 5 kHz or more and 25 kHz or less in the alternating voltage.

According to the invention, a frequency f1 in the first period is 5 kHz or more and 25 kHz or less. A case where f1 is lower than 5 kHz is not preferable because fog is increased. Meanwhile, in the case where f1 is higher than 25 kHz, a toner does not follow an electric field and the image density is decreased.

Further, in the invention, it is preferable that the peak-to-peak voltage in the first period Vpp(1) satisfies the following expression in the alternating voltage:

$$1\ \text{kV} \leqq Vpp(1) \leqq 3\ \text{kV}.$$

According to the invention, the peak-to-peak voltage in the first period Vpp(1) satisfies $1\ \text{kV} \leqq Vpp(1) \leqq 3\ \text{kV}$.

In the case where Vpp(1) is lower than 1 kV, the image density is insufficient. In the case where Vpp(1) is higher than 3 kV, a spot-like white void is easily generated due to a leak current between the electrostatic latent image bearing member and the developer bearing member, thus being difficult to use.

Further, in the invention, it is preferable that, t1 and t2 are differentiated at least in the first period of the alternating voltage, where t1 denotes a time during which the development-side potential is applied and t1 denotes a time during which the opposite development-side potential is applied.

According to the invention, t1 and t2 are differentiated at least in the first period, where t1 denotes a time during which the development-side potential is applied and t2 denotes a time during which the opposite development-side potential is applied. In the case of t1>t2, it is possible to further enhance fog, and in the case of t1<t2, it is possible to enhance dot reproducibility.

Further, in the invention, it is preferable that t1 and t2 satisfy the following expression at least in the first period of alternating voltage:

$$0.35 \leqq t1/(t1+t2) \leqq 0.70.$$

According to the invention, t1 and t2 satisfy $0.35 \leqq t1/(t1+t2) \leqq 0.70$ at least in the first period.

In the case of $t1/(t1+t2)<0.35$, fog is lowered, and in the case of $t1/(t1+t2)>0.70$, dot reproducibility is lowered.

Further, in the invention, it is preferable that a two-component developer including a toner and a carrier is used as a developer.

According to the invention, in the case where a two-component developer including a toner and a carrier is used as the developer, the toner is likely to separate from carrier and the utilization efficiency of toner is enhanced. Accordingly, such an effect is achieved that unevenness in magnetic chains is less likely to be conspicuous and it is suitable for development using two-component developer.

Further, in the invention, it is preferable that the developer bearing member includes a magnet roller that has a plurality of magnetic pole members arranged along a circumferential direction and a development sleeve fitted onto the magnet roller so as to rotate freely, and that the magnet roller has the magnetic pole members arranged so that an opposed position at which the electrostatic latent image bearing member and the developer bearing member are most adjacent to each other is in a middle of two magnetic pole members.

According to the invention, the developer bearing member includes a magnet roller that has a plurality of magnetic pole members arranged in a circumferential direction and a development sleeve fitted onto the magnet roller so as to rotate freely. In the magnet roller, the magnetic pole members are arranged so that an opposed position at which the electrostatic latent image bearing member and the developer bearing member are most adjacent to each other is in a middle of two magnetic pole members.

Accordingly, a face of the magnetic brush formed on the surface of the development sleeve, which is opposed to the developer bearing member, is flat near the opposed position. Such a magnetic brush secures a gap between toe surface of the developer bearing member, thus making it possible to prevent unevenness in an image due to scraping of the magnetic brush in development. Specifically, it is possible to improve graininess and to improve uniformity of a solid image and dot reproducibility.

Further, in the invention, it is preferable that the developing device is configured so that at least two kinds of toners are used for a single electrostatic latent image bearing member.

According to the invention, the developing device is configured so that at least two kinds of toners are used for a single electrostatic latent image bearing member and is suitable for a so-called image-on-image development system in which the toners are collectively transferred to a transfer material.

A plurality of kinds of toners are mixed when there is only the first period with a large Vpp, however, it is possible to suppress mix-in of other kinds of toners by providing the second period with a small Vpp.

Further, in the invention, it is preferable that the developing device carries out development using a toner whose shape factor SF-1 is 130 to 140 and whose shape factor SF-2 is 120 to 130.

According to the invention, it is preferable that the developing device carries out development using a toner whose shape factor SF-1 is 130 to 140 and whose shape factor SF-2 is 120 to 130.

Accordingly, it is possible to further improve graininess.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
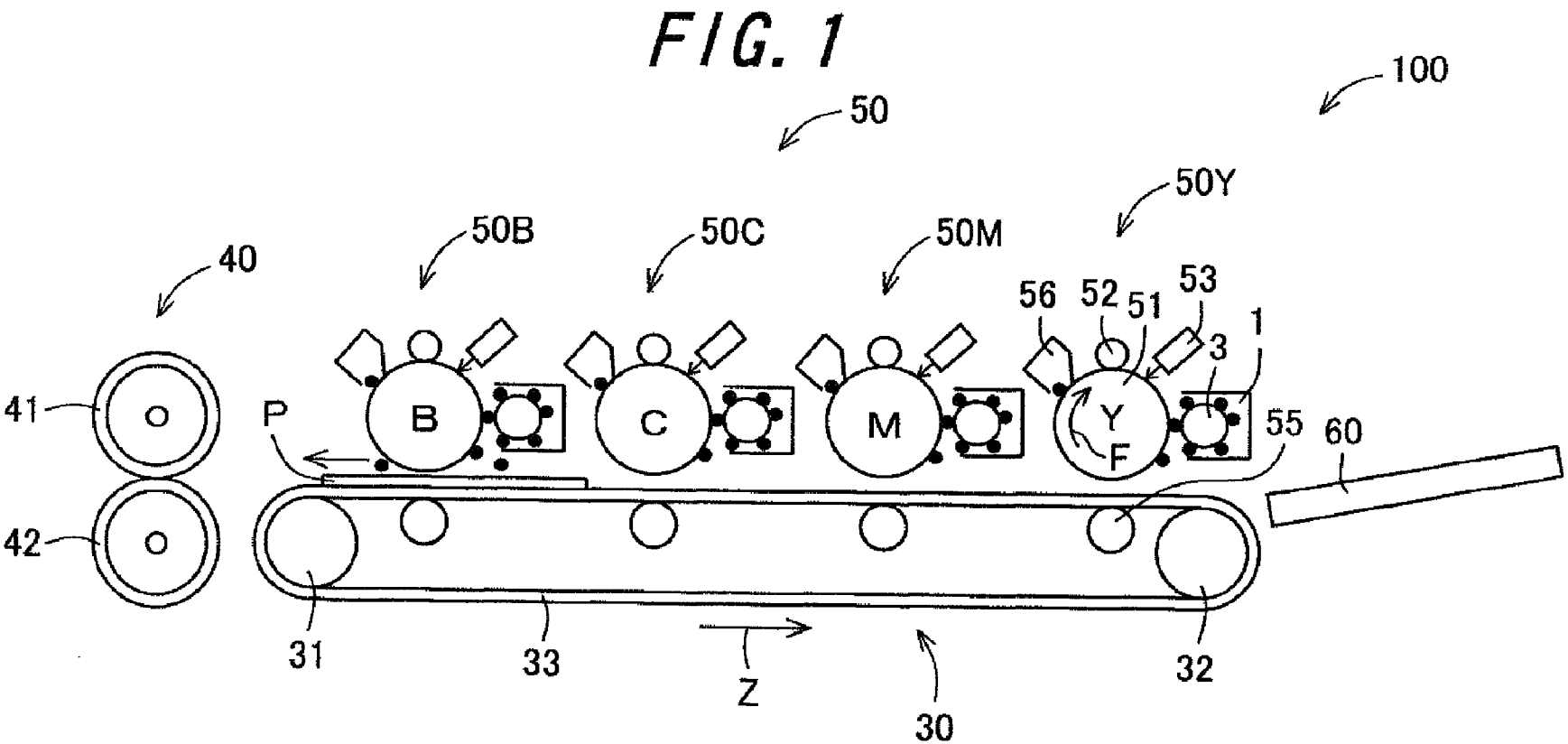
FIG. 1 is a vertical cross sectional view schematically showing an overview of an entire configuration of an image forming apparatus according to a first embodiment.

Now referring to the drawings, preferred embodiments of the invention are described below.

Note that, in this specification and drawings, the components having substantially the same functions are allotted with the same reference numerals so that repeated description will be omitted.

First, a configuration of a first embodiment of an image forming apparatus according to the invention will be described with reference to the drawing. FIG. 1 is a vertical cross sectional view schematically showing an overview of an entire configuration of an image forming apparatus 100 according to a first embodiment. Note that, for simplicity, FIG. 1 shows an example of the image forming apparatus 100 of this embodiment mainly with principal components, which is not limited to a configuration of an image forming apparatus that performs a development method according to the invention.

The image forming apparatus 100 is a tandem type color image forming apparatus capable of forming a color image, which includes a plurality of photoreceptors 51 serving as an electrostatic latent image bearing member (in this embodiment, four photoreceptors for yellow images, magenta images, cyan images, and black images). The image forming apparatus 100 has a printer function of forming a color image or a monochrome image on a sheet P serving as a transfer receiving member (recording medium) based on image data transmitted from various kinds of information processing terminal apparatus (not shown) such as a PC (Personal Computer) connected through a network (not shown) or image data read by a document reading apparatus (not shown) such as a scanner.

As shown in FIG. 1, the image forming apparatus 100 includes image forming station section 50 (50Y, 50M, 50C, and 50B) having a function of forming an image on the sheet P, a fixing device 40 having a function of fixing a toner image formed on the recording medium P at the image forming station section 50, and a transport section 30 having a function of transporting the recording medium P from a feed tray 60 on which the recording medium P is placed to the image forming station section 50 and the fixing device 40.

The image forming station section 50 is configured with four image forming stations 50Y, 50M, 50C, and 50B for yellow images, magenta images, cyan images, and black images, respectively.

Specifically, the yellow image forming station 50Y, the magenta image forming station 50M, the cyan image forming station 50C, and the black image forming station SOB are disposed in this order from the side of the feed tray 60 between the feed tray 60 and the fixing device 40.

The image forming stations 50Y, 50M, 50C, and 50B for the respective colors have substantially the same structure, and form yellow, magenta, cyan, and black images according to image data corresponding to the respective colors so that the images are eventually transferred onto the sheet P serving as the transfer receiving member (recording medium).

The image forming station section 50 of this embodiment has a configuration to form images in four colors of yellow, magenta, cyan, and black, but may have a configuration to form images in six colors additionally including, for example, light cyan (LC) and light magenta (Lm) that have the same color hues as cyan and magenta and have a lower density, without limitation to the four colors.

Note that, in FIG. 1, the components of the respective image forming station section are shown with alphanumeric references on the yellow image forming station 50Y as a representative, and the alphanumeric references of the components of the other image forming stations 50M, 50C, and 50S are omitted.

The image forming stations 50Y, 50M, 50C, and 50B respectively includes the photoreceptor 51 serving as a latent image bearing member on which an electrostatic latent image is formed, and a charging device 52, an exposure unit 53, a developing device 1, a transfer device 55, and a cleaning unit SC are disposed in the circumferential direction around the photoreceptor 51.

The photoreceptor 51 is in the shape of a substantially cylindrical drum on the surface of which a photosensitive material such as an OPC (Organic Photoconductor) is provided, and is disposed below the exposure unit 53 and controlled so as to be rotationally driven in a predetermined direction (in the direction shown with an arrow F in the figure) by a driving section and a control section.

The charging device 52 is a charging section that uniformly charges the surface of the photoreceptor 51 to a predetermined potential, and is disposed above the photoreceptor 51 so as to be close to a peripheral surface thereof. In this embodiment, a roller system charging roller in a contact type is used, but a charging device of a charger type, a brush type, an ion emission-charging type or the like may be used as a substitution therefor.

The exposure unit 53 has a function of exposing the surface of the photoreceptor 51 that is charged with the charging device 52 by irradiating it with laser light based on image data outputted from an image processing section (not shown) to thereby write and form an electrostatic latent image according to the image data on the surface. The exposure unit 53 forms an electrostatic latent image in a corresponding color when image data that corresponds to yellow, magenta, cyan, or black is inputted respectively according to the image forming stations 50Y, 50M, 50C, or 50B. As the exposure unit 53, a laser scanning unit (LSU) including a laser irradiation section and a reflection mirror or a write device (for example, a write head) in which light emitting elements such as ELs and LEDs are arranged in an array is usable.

The developing device 1 has a developing roller 3 serving as a developer bearing member that bears developer. The developing roller 3 is configured so that developer is transported to a development region in which toner can move to the photoreceptor 51. In this embodiment, the developing device 1 uses two-component developer including toner and carrier, and forms a toner image (visible image) by performing reversal development with the toner of an electrostatic latent image that has been formed on the surface of the photoreceptor 51 by the exposure unit 53.

The developing device 1 contains yellow, magenta, cyan, or black developer according to image formation of the respective image forming stations 50Y, 50M, 50C, and 50B. The developer includes toner that is charged with a polarity the same as the surface potential that is charged to the photoreceptor 51. Note that, the polarity of the surface potential that is charged to the photoreceptor 51 and the charged polarity of the toner used are both negative in this example.

The transfer device 55 transfers a toner image on the photoreceptor 51 to the transfer receiving member P that is transported by a transport belt 33, and is provided with a transfer roller to which a bias voltage that has a polarity (positive in this example) opposite to the charged polarity of the toner is applied.

The cleaning unit 56 removes and collects the toner remaining on the peripheral surface of the photoreceptor 51 after the development and image transfer to the sheet P serving as the transfer receiving member. In this embodiment, the cleaning unit 56 is disposed substantially horizontally in the side of the photoreceptor 51 at a position substantially facing the developing device 1 across the photoreceptor 51 (in the left side in FIG. 1).

The transport section 30 includes a drive roller 31, a driven roller 32, and the transport belt 33, and transports the transfer receiving member P to which toner images in the respective colors are transferred in the image forming stations 50Y, 50M, 50C, and 50B. The transport section 30 is configured so that the endless transport belt 33 is routed around the drive roller 31 and the driven roller 32, and transports the sheet P serving as the transfer receiving member (recording medium) that is fed from the feed tray 60 to each of the image forming stations 50Y, 50M, 50C, and 50B sequentially.

The fixing device 40 includes a heat roller 41 and a pressure roller 42, and by transporting the transfer receiving member P to a nip portion, applies heat and pressure to the toner image transferred to the sheet P to fix on the sheet P.

Moreover, the image forming apparatus 100 of this embodiment includes a bias voltage applying section that applies an oscillating bias voltage to the developing roller 3 so that a potential difference between the developing roller 3 and the photoreceptor 51 is changed continuously and periodically. The oscillating bias voltage is an alternating voltage in which a development-side electrical potential that can apply a force to the toner to be charged in the direction from the developing roller 3 to the photoreceptor 51 and an opposite development-side electrical potential that can apply a force to the toner to be charged in the direction from the photoreceptor 51 to the developing roller 3 alternate with each other. The application of the oscillating bias voltage will be described in detail later.

In the image forming apparatus 100 in such a configuration, when the sheet P that is transported by the transport section 30 passes positions at which the photoreceptor 51 faces the respective image forming stations 50Y, 50M, 50C, and 50B, the toner images on the respective photoreceptors 51 are successively transferred to the sheet P with the action of a transfer electric field of the transfer rollers of the transfer device 55 that is disposed below the facing positions thorough the transport belt 33. This layers toner images in the respective colors on the sheet P to form a desired full-color image on the sheet P. The sheet P serving as the transfer receiving member on which the toner image is transferred in such a manner is subjected to a fixing process of the toner image at the fixing device 40 and thereafter is discharged to a discharge tray (not shown).

Figure 2:
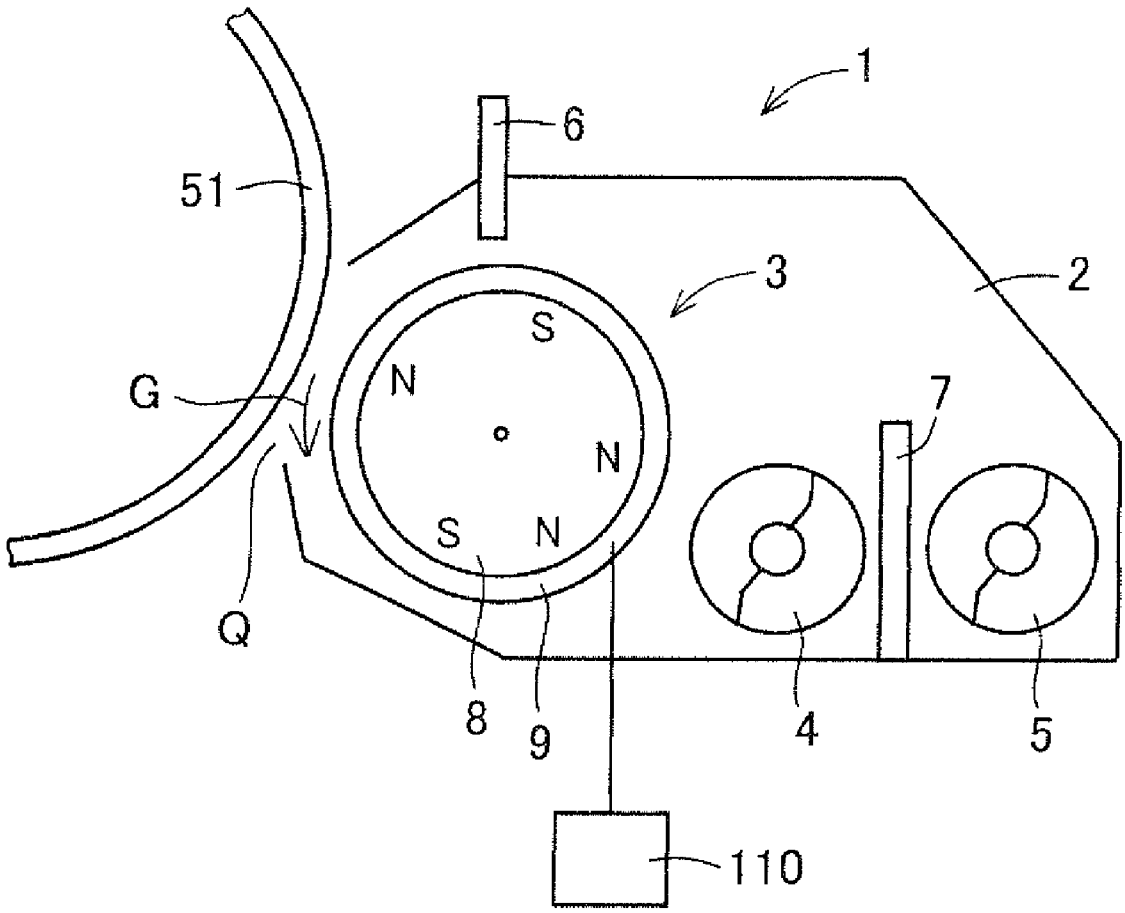
FIG. 2 is a schematic view showing an outline of the structure of the developing device in the respective image forming stations shown in FIG. 1

Next, the structure of the developing device 1 will be described with reference to the diagram. FIG. 2 is a schematic view showing an outline of the structure of the developing device 1 in toe respective image forming stations shown in FIG. 1. Note that, FIG. 2 shows an example in which the primary components of the developing device 1 are mainly described simplistically, without any limitation to the structure of the developing device implementing the developing method according to the invention.

As shown in FIG. 2, the developing device 1 includes, in addition to the above-described developing roller 3, a regulation blade 6 serving as a regulation member that regulates the layer thickness of developer on the developing roller 3, a pair of agitating/conveying screws 4 and 5 serving as agitating/conveying members that convey the developer to the developing roller 3 and agitate the developer, and a developing tank 2 that contains two-component developer including toner and carrier.

In the developing tank 2, the pair of agitating/conveying screws 4 and 5 are disposed so as to be substantially in parallel to each other. A partition 7 is provided between the agitating/conveying screws 4 and 5 so as to partition the developing tank 2 therebetween except for both end sides in the axial line direction. By providing the partition 7 in the developing tank 2 in this way, separate developer conveying paths are formed on both sides of the partition 7 within the developing tank 2. In addition, in the developing device 1, toner in the developer contained in the developing tank 2 is agitated with carrier by an agitation operation of the agitating/conveying screws 4 and 5 disposed in the developing tank 2 so as to be frictionally charged.

Moreover, an opening section for development Q is provided at a position in the development unit 2 that faces the photoreceptor 51, and the developing roller 3 is disposed in the developing tank 2 in a state where a part of which is exposed from the opening section Q of the development unit 2 with a development gap (about 0.3 to 1.0 mm) between the photoreceptor 51.

The developing roller 3 has a magnet roller 8 in which a plurality of magnetic pole members are arranged along the circumferential direction, and a nonmagnetic development sleeve 9 formed with aluminum alloy and brass in a substantially cylindrical shape that is fitted in the magnet roller 8 so as to rotate freely in a fixed direction (in the direction shown with arrow G in FIG. 2), and is configured so that the development sleeve 9 is rotationally driven in a predetermined direction (in the direction shown with arrow G in FIG. 2) by a control section and driving section (not shown).

The developer is two-component developer including toner and carrier that is composed of a magnetic substance. The developer is attracted to the surface of the development sleeve 9 by the magnetic force of the magnet, and is conveyed on the development sleeve 9 along the rotational direction G of the development sleeve 9. At this time, the carrier is attracted to the surface of the development sleeve 9 by the magnetic force of the magnet roller 8 so as to form a magnetic brush, and the toner is attached to the carrier by Coulomb force due to the frictional charge.

In addition, a tip portion of the regulation blade 6 is disposed so as to face the development sleeve 9 in the upstream side of the rotational direction G of the development sleeve 9 in the opening section for development Q. In this embodiment, the regulation blade 6 is configured so that the layer thickness of developer formed on the surface of the developing roller 3 is regulated.

By configuring the developing device 1 of this embodiment as described above, the developing device 1 forms a toner image by supplying a constant amount of developer to a position that faces the photoreceptor 51, attracting the toner in the developer supplied to the facing position with the electrostatic force of an electrostatic latent image formed on the surface of the photoreceptor 51, and developing the electrostatic latent image. Also, in the developing device 1, the carrier and the toner that has not been used for development of the developer supplied to the facing position returns into the developing tank 2 with the rotation of the development sleeve 9.

As toner included in the developer to be used in the invention, a toner whose shape factor SF-1 is in a range of 100 to 160 and toner whose shape factor SF-2 is in a range of 100 to 150 are usable, and more preferably, the SF-1 is 110 to 150 and the SF-2 is 110 to 140.

The toner shape factor SF-1 represents a degree of a roundness of toner particles and the shape factor SF-2 represents a degree of unevenness of the surface of toner particles. The shape factor is a value obtained by randomly sampling 100 toner images magnified 500 times that have been shot with the use of, for example, FE-SEM (S-800) manufactured by Hitachi, Ltd. and analyzing image information thereof with an image analysis apparatus (Luzex III) manufactured by Nireco Corporation, for example.

In the case of SF-1<110, toner has a shape similar to a spherical shape, and therefore, there is a case where the toner slips on an endless conveyance belt to cause distortion of a transfer image when the toner is transferred from the photoreceptor to the endless conveyance belt. In the case of SF-1>150, toner is greatly deformed and a projected portion on the toner surface is separated from the toner surface by stirring to be fine powders which cause toner dispersion or adhere to the carrier surface or the development sleeve surface, resulting in inhibition of sufficient friction charge with the toner in some cases.

Further, in the case of SF-2<110, the toner surface has high smoothness, and there is a case where the toner slips on the endless conveyance belt to cause distortion of the transfer image similarly to the case of SF-1<110. In the case of SF-2>140, toner surface has large unevenness, and there is a case where a variation is generated in a charge amount of individual toner and the image density is not stabilized to cause fog.

Further, a toner weight in an image area having 100% image area rate of a transfer image falls within a range of 0.20 to 0.50 mg/cm$^2$, and in the case or a transfer image of processed black (a state of black formed by overlapping three colors of yellow, cyan, and magenta), the toner weight in the image area having 100% image area rate of the transfer image is preferably adjusted within a range of 0.60 to 1.5 mg/cm$^2$.

In the case of the toner weight<0.20 mg, it is impossible to cover a paper face fully with toner, and therefore, uniform and sufficient image density is unable to be obtained. In the case of the toner weight>0.50 mg, a toner layer is thickened particularly in the case of overlapping three colors and temperature margin at a fixing step is made severe greatly.

The toner to be used in the invention is able to be prepared by a known manufacturing method, and examples thereof include a pulverizing method, a suspension polymerization method, an emulsion polymerization method, a solution polymerization method, and an ester elongation polymerization method. As carrier, ferrite resin coated carrier having a volume average particle size of 40 μm was used. Without limitation to the ferrite resin coated carrier in particular, ferrite non-resin-coated carrier, an iron powder type and a binder type carrier are also usable.

As a result of measuring an electric charge of a mirror image remaining on carrier by a commercially available coulombmeter when about 200 mg of two-component developer was put on a metal mesh of 500 mesh in an electrically shielded case and toner was sucked by air through the metal mesh, a charge amount of the toner was about −30 μC/g.

Next, a developing operation executed by the developing device 1 of the image forming apparatus 100 will be described with reference to the drawings.

First Embodiment

Figure 3:
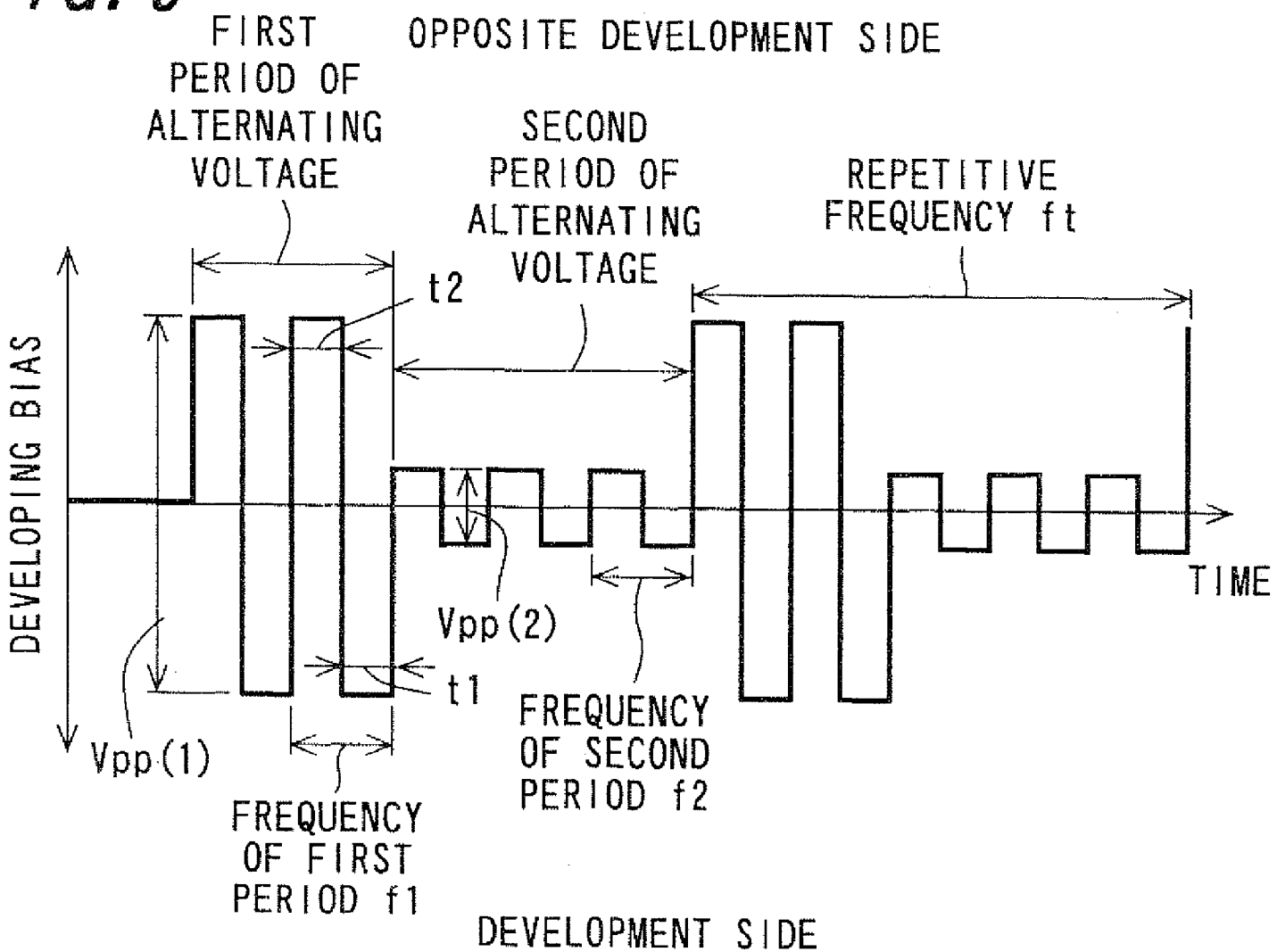
FIG. 3 is a view showing a development bias voltage waveform of the invention.

The bias voltage applying section 110 applies a bias voltage that has a waveform as shown in FIG. 3 to the development sleeve 9 of the developing roller 3 which is an oscillating bias voltage as an alternating voltage in which a development-side electrical potential that applies a force to move the toner from the developing roller 3 to the photoreceptor 51 and an opposite development-side electrical potential that applies a force to move the toner from the photoreceptor 51 to the developing roller 3 alternate with each other periodically.

As shown in the waveform of FIG. 3, in this embodiment, a bias voltage waveform is repeatedly applied in which a first period where a peak-to-peak voltage (hereinafter, referred to as Vpp) of a bias voltage is large and subsequently a second period where Vpp is small are provided. In addition, when a frequency f1 of the first period and a frequency f2 of the second period satisfy f1=f2, and when a time during which a development-side potential to move toner from the development sleeve 9 to the photoreceptor 51 is applied is t1 and a time during which an opposite development-side potential to move toner from the photoreceptor 51 to the development sleeve 9 is applied is t2, t1=t2 is satisfied.

By providing the first period during which Vpp(1) which is a large Vpp is applied, a large electric field acts on toner in the first period so that the toner is easily separated from carrier and the toner flies from the carrier to the photoreceptor 51. A flying amount of the toner at this time is substantially the same as in the case of using the waveform in which constantly the same Vpp is applied repeatedly. In addition, a state where Vpp(1) is applied is shifted to a state where Vpp(2) which is a small Vpp is applied so that dot reproducibility is improved. This seems to be because the toner flying to the photoreceptor 51 in the first period during which a large Vpp(1) is applied moves gradually to a dot latent image to thereby form stable dots.

Figure 4:
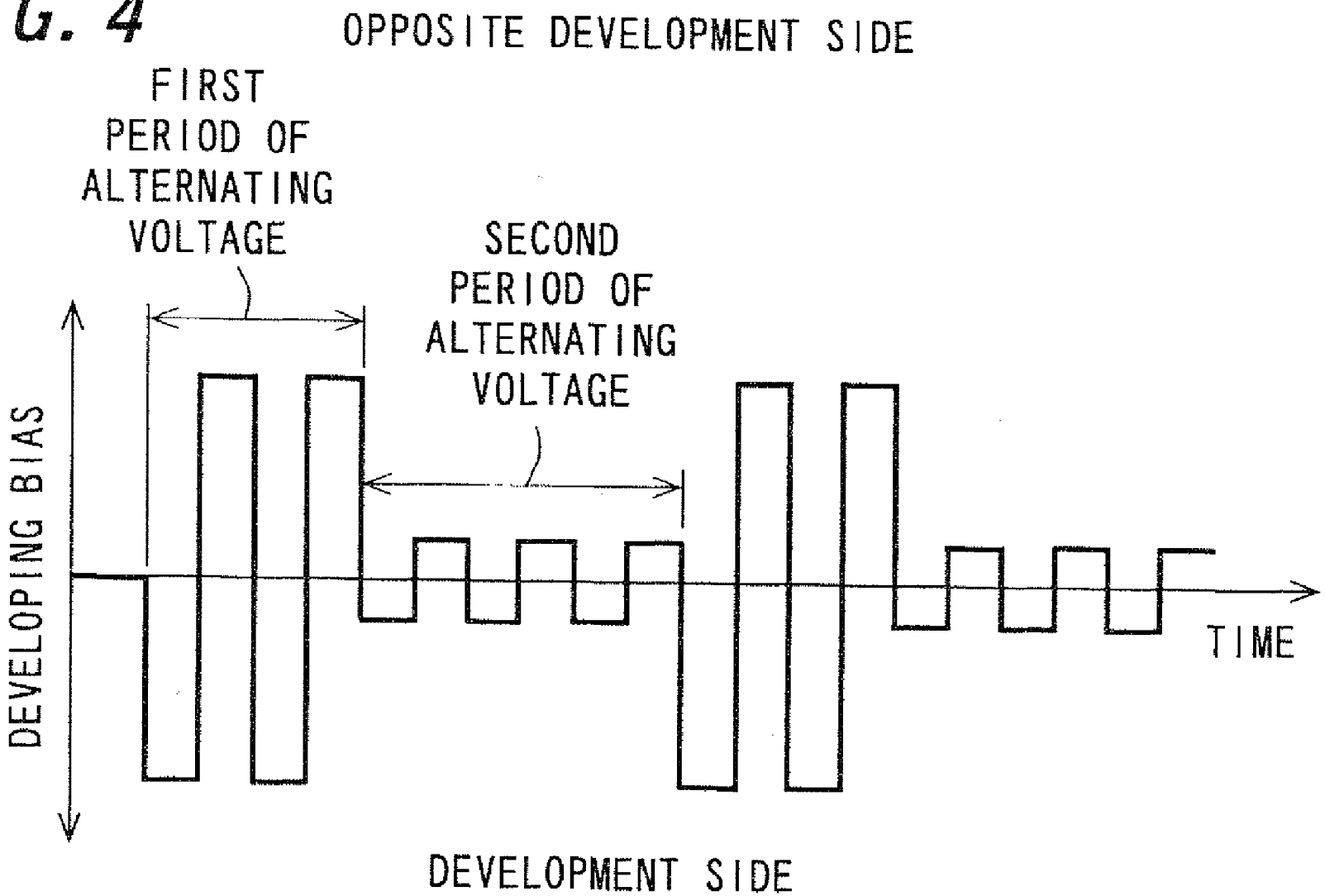
FIG. 4 is a view showing a development bias voltage waveform in a case where a potential finally applied an opposite development-side potential.

Further, as shown in FIG. 3, the potential finally applied in the first period (final potential) is preferably the development-side potential. As will be described in detail below, in the case of the bias waveform as shown in FIG. 4, that is, in the case where the potential finally applied in the first period is the opposite development-side potential, the image density is decreased and dot reproducibility is lowered.

It is important that the first period during which a large Vpp is applied is completed with the development-side potential finally applied and is directed to the second period in a state where toner is moving to the photoreceptor 51 to reduce Vpp. Thereby, the toner is easily developed to a latent image and the toner is also gradually developed to a dot latent image at the same time.

In contrast, when the first period is completed with the opposite development-side potential finally applied, the period is shifted to the second period in a state where an electric filed is applied in a direction that the toner returns to the development sleeve 9 and Vpp is reduced, thus, the toner is hardly directed to the photoreceptor 51 and dots are hardly reproduced. Accordingly, the image density is low and dot reproducibility is lowered.

To study the first embodiment more specifically, experiments were conducted as follows. Note that, unless otherwise mentioned, the following experiment data were obtained by using a multifunctional peripheral MX-7001N manufactured by Sharp Corporation as an image forming apparatus. However, various developing bias waveforms were output by using an arbitrary waveform generator (trade name: HIOKI 7075, manufactured by HIOKI E. E. CORPORATION) and an amplifier (trade name: HVA4321, manufactured by NF Corporation). The toner used for the experiments has the volume average particle size of 7 micron, which was measured by a commercially available Coulter Counter model TA-II.

Further, the image density was obtained by measuring a solid image density by a portable spectrodensitometer (trade name: X-Rite 939, manufactured by X-Rite Incorporated). Dot reproducibility was simply evaluated by printing an isolated dot in which printing was made for one dot and no printing was made for three dots and measuring a density of an area including the isolated dot. Moreover, a density of a non-image area having no printing was measured in the same manner as the case of dot reproducibility to evaluate fog by a difference from a density of a blank sheet not subjected to a printing step. The densitometer used for evaluating dot reproducibility and fog was the same one used for measuring a solid image density.

First, Example 1 was conducted such that Vpp(1) was 1.6 kV, Vpp(2) was 560 V, the frequency f1 in the first period was 1.0 kHz, the frequency f2 in the second period was 2 kHz, the periodic number in the first period was twice, and the periodic number in the second period was three times.

Figure 9:
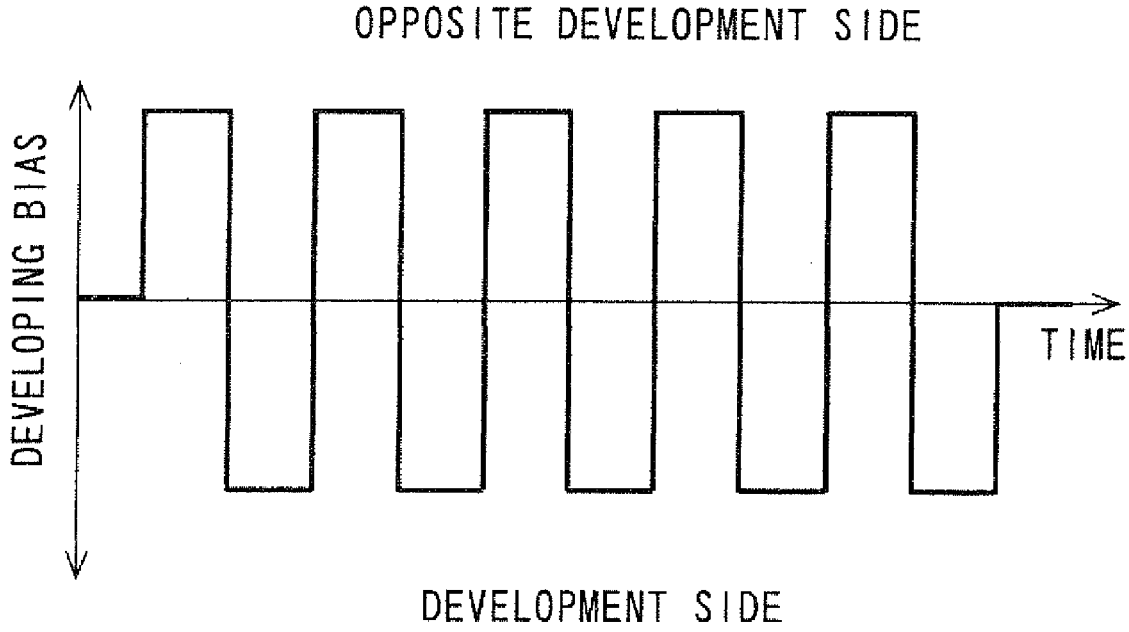
FIG. 9 PRIOR ART
FIG. 9 is a view showing a conventional development bias voltage waveform.
Figure 10:
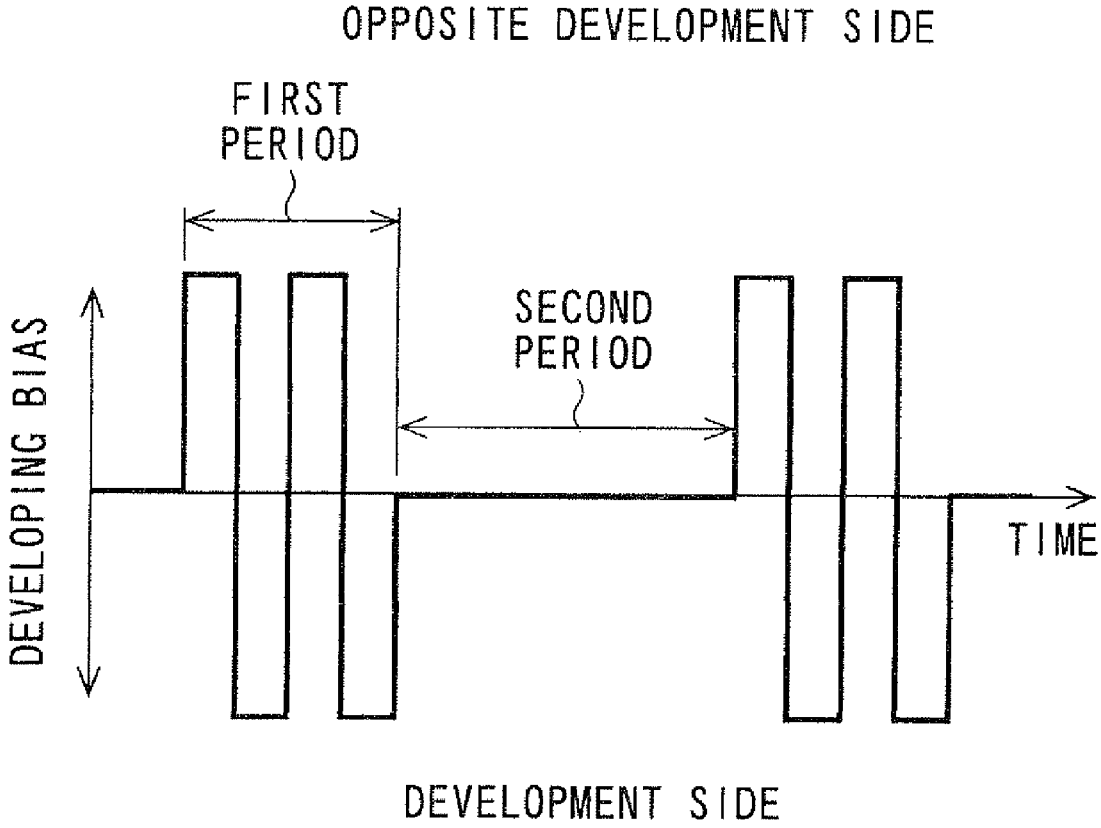
FIG. 10 PRIOR ART
FIG. 10 is a view showing a conventional development bias voltage waveform.
Figure 11:
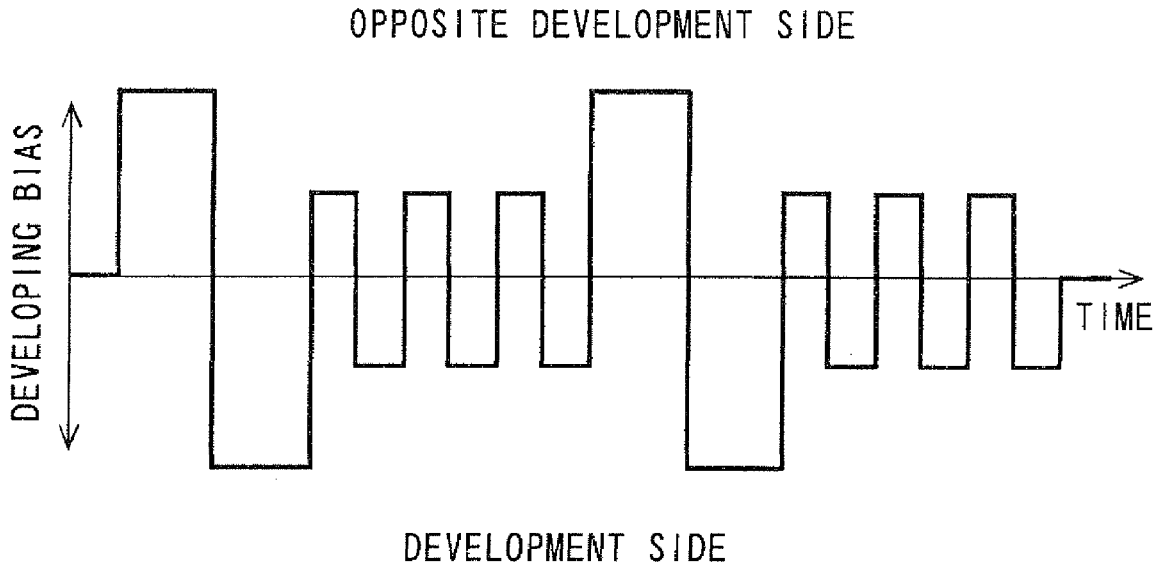
FIG. 11 PRIOR ART
FIG. 11 is a view showing a conventional development bias voltage waveform.

Comparative example 1 was conducted such that the bias voltage of the waveform shown in FIG. 9 was applied with Duty 50%, Vpp=800 V, and the frequency of 10 kHz.

Figure 5:
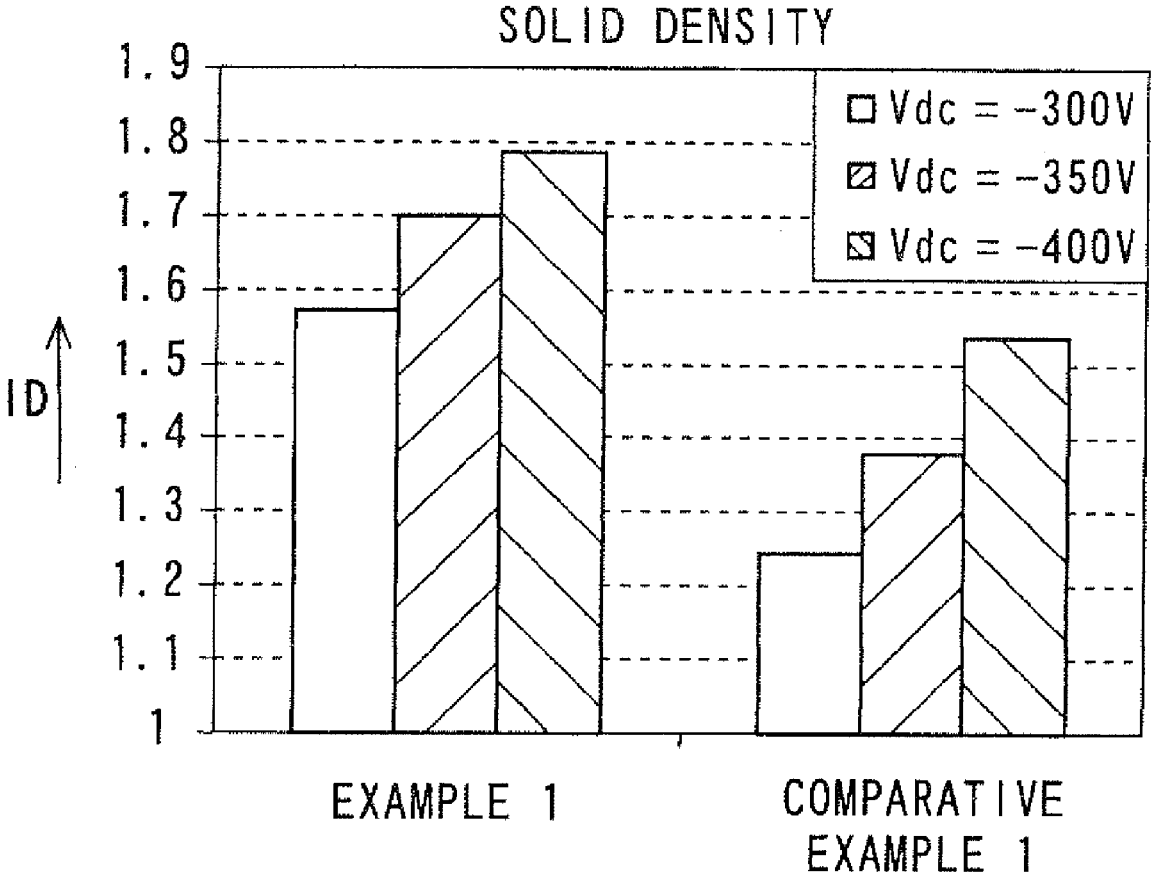
FIG. 5 is a graph showing comparison results of image density between Example and Comparative examples.

A DC component Vdc of the developing bias was changed into three kinds of −300 V, −350 V, and −400 V to measure the image density of a solid area. A graph of FIG. 5 shows results. The image density (ID) of the solid image is taken along the vertical axis of the graph.

Comparing Example 1 and Comparative example 1, the image density higher by about 0.3 than Comparative example 1 was obtained in Example 1 regardless of the DC component Vdc of the developing bias. This seems to be because of the first period during which a large Vpp is applied as described above.

Figure 6:
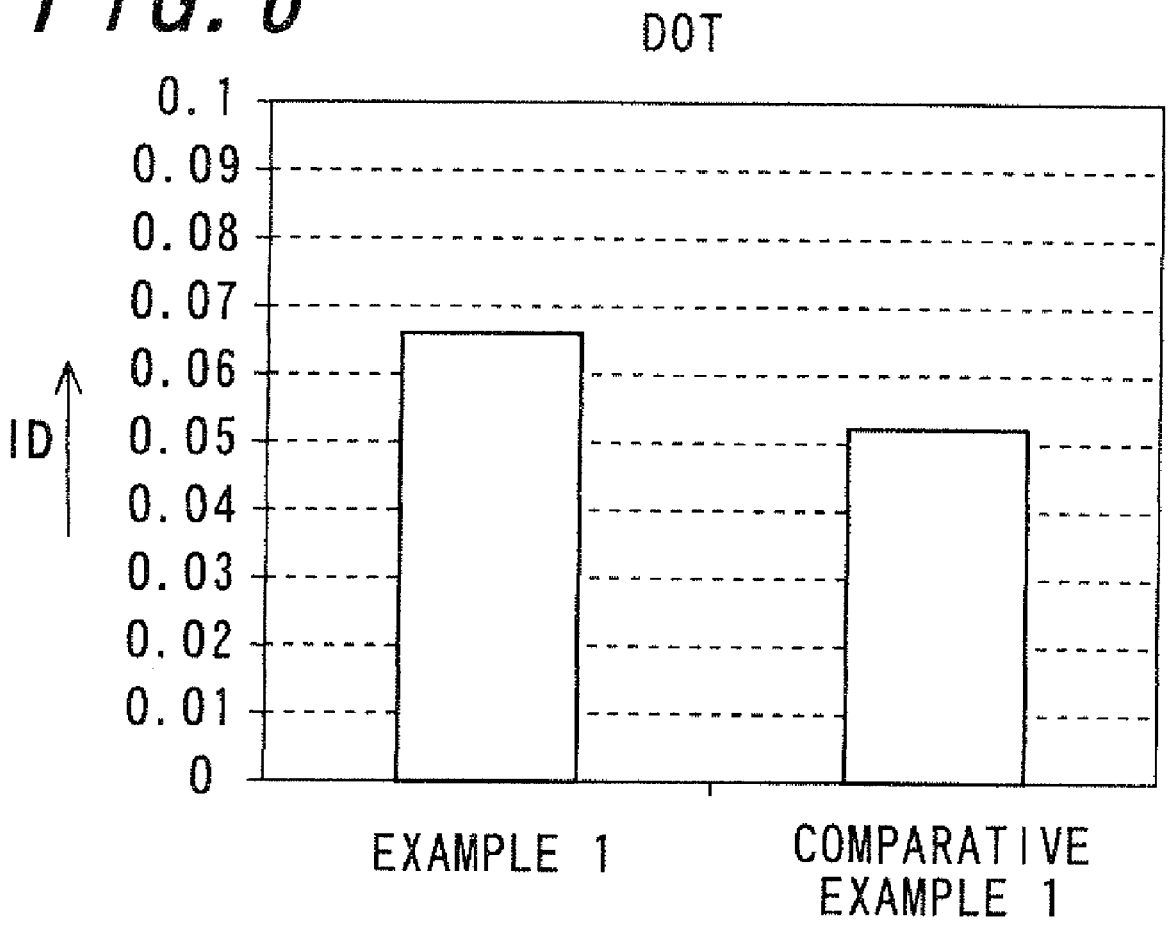
FIG. 6 is a graph showing comparison results of dot reproducibility between Example and Comparative examples.

Then, the image density of an isolated dot in which printing was made for one dot and no printing was made for three dots was measured. The image density of the isolated dot represents dot reproducibility, and the reproducibility is able to be determined as being excellent as the image density is higher. A graph of FIG. 6 shows results. The image density (ID) of the isolated dot is taken along the vertical axis of the graph.

Comparing Example 1 and Comparative example 1, the image density higher than the Comparative example 1 was obtained in Example 1. This seems to be because of the second period during which a small Vpp is applied as described above.

A difference between a non-Image area potential of the photoreceptor 51 and a DC voltage of the developing bias was defined as a cleaning field (hereinafter referred to as a CF) and a difference between the image density of the non-image area and the image density of a blank sheet (ΔID) in a case where the CF was changed into 150 V, 100 V, and 50 V was measured, respectively. The ΔID represents fog and the fog is able to be determined as being suppressed as the ΔID is smaller.

Figure 7:
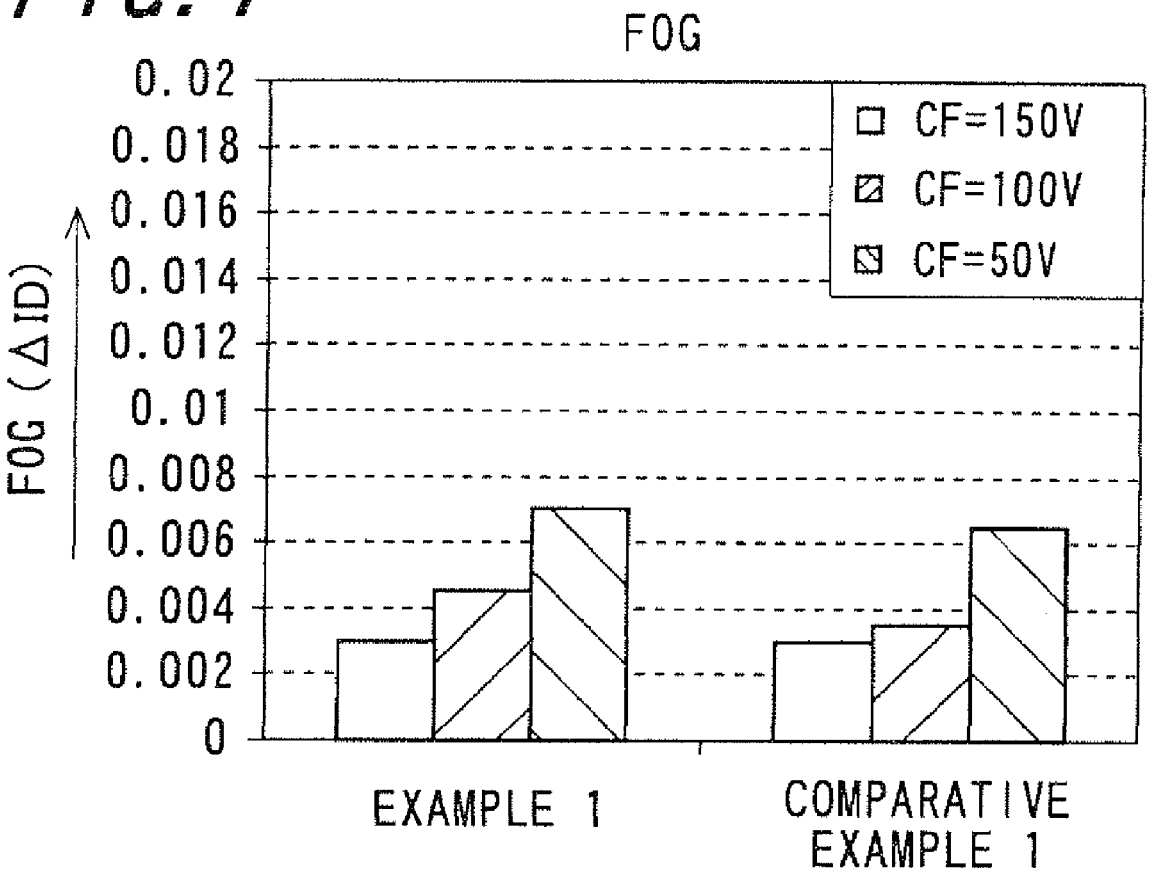
FIG. 7 is a graph showing comparison results of fog between Example and Comparative example.

A graph of FIG. 7 shows results. The image density difference (ΔID) is taken along the vertical axis of the graph.

Comparing Example 1 and Comparative example 1, the image density differences were almost the same regardless of the CF.

and fog in the same manner as the above. Note that, it was defined as the first frequency f1=the second frequency f2.

Based on a total period of the first period and the second period, the repetitive frequency ft represents a frequency of repetitive periods in this total period. The first periodic number represents the number of periods included in the first period and the second periodic number represents the number of periods included in the second period. Moreover, in the final potential, the case where the final potential was the development-side potential was shown as "positive" and the case of the opposite development-side potential was shown as "opposite".

As to the evaluation results, Table 1 shows comprehensive results compared to the result of Comparative example 1. Compared to Comparative example 1, the exceeding result was represented by "Good", the equivalent result was represented by "Not bad", and the lower result was represented by "Poor". Moreover, the evaluation of Comparative example 2 was carried out under the same conditions as Comparative example 1 except for that it was defined as Vpp=1600 V.

TABLE 1

| Conditions | Vpp(1) [V] | Vpp(2) [V] | f1(=f2) [kHz] | ft [kHz] | First periodic number | Second periodic number | Vpp(2)/Vpp(1) | Positive/ Opposite | Image density | Dot reproducibility | Fog |
|---|---|---|---|---|---|---|---|---|---|---|---|
| Condition 1 | 1600 | 0 | 10 | 2.0 | 2 | 3 | 0.000 | Positive | Good | Good | Poor |
| Condition 2 | 1600 | 160 | 10 | 2.0 | 2 | 3 | 0.100 | Positive | Good | Good | Not bad |
| Condition 3 | 1600 | 320 | 10 | 2.0 | 2 | 3 | 0.200 | Positive | Good | Good | Not bad |
| Condition 4 | 1600 | 400 | 10 | 2.0 | 2 | 3 | 0.250 | Positive | Good | Good | Good |
| Condition 5 | 1600 | 480 | 10 | 2.0 | 2 | 3 | 0.300 | Positive | Good | Good | Good |
| Condition 6 | 1600 | 560 | 10 | 2.0 | 2 | 3 | 0.350 | Positive | Good | Good | Good |
| Condition 7 | 1600 | 640 | 10 | 2.0 | 2 | 3 | 0.400 | Positive | Good | Good | Good |
| Condition 8 | 1600 | 720 | 10 | 2.0 | 2 | 3 | 0.450 | Positive | Good | Not bad | Good |
| Condition 9 | 1600 | 800 | 10 | 2.0 | 2 | 3 | 0.500 | Positive | Good | Not bad | Good |
| Condition 10 | 1600 | 960 | 10 | 2.0 | 2 | 3 | 0.600 | Positive | Good | Poor | Good |
| Condition 11 | 1400 | 400 | 10 | 2.0 | 2 | 3 | 0.286 | Positive | Good | Good | Not bad |
| Condition 12 | 1200 | 400 | 10 | 2.0 | 2 | 3 | 0.333 | Positive | Good | Good | Good |
| Condition 13 | 1000 | 400 | 10 | 2.0 | 2 | 3 | 0.400 | Positive | Good | Good | Good |
| Condition 14 | 750 | 400 | 10 | 2.0 | 2 | 3 | 0.533 | Positive | Poor | Good | Good |
| Condition 15 | 1600 | 320 | 10 | 1.67 | 3 | 3 | 0.200 | Positive | Good | Not bad | Good |
| Condition 16 | 1600 | 320 | 10 | 1.43 | 4 | 3 | 0.200 | Positive | Good | Poor | Good |
| Condition 17 | 1600 | 320 | 10 | 2.0 | 3 | 2 | 0.200 | Positive | Good | Not bad | Good |
| Condition 18 | 1600 | 320 | 10 | 2.5 | 3 | 1 | 0.200 | Positive | Good | Poor | Good |
| Condition 19 | 1600 | 240 | 10 | 2.0 | 3 | 2 | 0.150 | Positive | Good | Not bad | Good |
| Condition 20 | 1600 | 140 | 10 | 2.0 | 3 | 2 | 0.088 | Positive | Good | Not bad | Poor |
| Condition 21 | 1600 | 320 | 10 | 2.5 | 1 | 3 | 0.200 | Positive | Good | Good | Poor |
| Condition 22 | 1600 | 480 | 3 | 0.6 | 2 | 3 | 0.300 | Positive | Good | Good | Poor |
| Condition 23 | 1600 | 480 | 5 | 1.0 | 2 | 3 | 0.300 | Positive | Good | Good | Not bad |
| Condition 24 | 1600 | 480 | 8 | 1.6 | 2 | 3 | 0.300 | Positive | Good | Good | Good |
| Condition 25 | 1600 | 480 | 15 | 3.0 | 2 | 3 | 0.300 | Positive | Good | Good | Good |
| Condition 26 | 1600 | 480 | 20 | 4.0 | 2 | 3 | 0.300 | Positive | Not bad | Good | Good |
| Condition 27 | 1600 | 480 | 25 | 5.0 | 2 | 3 | 0.300 | Positive | Poor | Not bad | Good |
| Condition 28 | 3000 | 320 | 10 | 2.0 | 2 | 3 | 0.107 | Positive | Good | Not bad | Good |
| Condition 29 | 1600 | 400 | 10 | 2.0 | 2 | 3 | 0.250 | Opposite | Poor | Poor | Good |
| Comparative example 1 | 800 | — | 10 | — | — | — | — | — | — | — | — |
| Comparative example 2 | 1600 | — | 10 | — | — | — | — | — | Good | Poor | Good |

According to the results, the result of Example 1 showed that dot reproducibility was improved and toner fog was not deteriorated while increasing the image density.

Next, the waveform of the developing bias was fixed to the waveform shown in FIG. 3 and parameters of Vpp(1), Vpp(2), Vpp(2)/Vpp(1), the first frequency f1, the second frequency f2, the repetitive frequency ft, the first periodic number, the second periodic number, and the final potential were changed variously to evaluate the image density, dot reproducibility, Comparing the condition 4 and the condition 29, the different condition was that the final potential of the condition 4 was positive and the final potential of the condition 29 was opposite.

In this case, the result under the condition 29 was that both the image density and dot reproducibility were lower than Comparative example 1. It seems that, in a case where the final potential was opposite as described above, toner was hardly directed to the photoreceptor 51 and dots were hardly reproduced in the second period, thus the image density was low and dot reproducibility was lowered.

Comparing the conditions 3, 15, 16, and 21, it was found that the first periodic number was preferably twice or three times. When the first periodic number was once like in the condition 21, a capability of returning toner from the photoreceptor 51 to the development sleeve 9 was insufficient, thus making it impossible to prevent deterioration of fog. When the first periodic number was four times or more like in the condition 16, the capability of returning toner from the photoreceptor 51 to the development sleeve 9 was so strong adversely that dot reproducibility was deteriorated. As a result, the first periodic number was preferably twice or three times.

Comparing the conditions 15, 17, and 18, it was found that the second periodic number was preferably twice or more. When the second periodic number was once like in the condition 18, a time for moving toner from the development sleeve 9 to the photoreceptor 51 gradually lacks, thus making it impossible to prevent that dot reproducibility is lowered. As a result, the second periodic number was preferably twice or more.

Comparing the conditions 1 to 10, 19, and 20, the conditions were such that Vpp(1) was 1600 V constantly and Vpp (2) was changed from 0 V to 960 V.

In a case where a rate of Vpp(2) to Vpp(1) was Vpp(2)/Vpp (1), fog was lowered when Vpp(2)/Vpp(1) was smaller than 0.1 like in the condition 20, and dot reproducibility was lowered when Vpp(2)/Vpp(1) was larger than 0.5 like in the condition 10.

An amount of toner flying to the photoreceptor 51 was increased in the first period during which Vpp(1) was applied so that the toner was moved to a latent image on the photoreceptor 51 in the second period during which Vpp(2) was applied, and when the value of Vpp(2) was reduced, the toner was easily moved to the latent image so that dot reproducibility was improved, however, when the value was too small, fog was lowered. Thus, according to the results, Vpp(2)/Vpp(1) was preferably 0.1 to 0.5, and more preferably 0.25 to 0.4.

Comparing the conditions 5 and 22 to 27, the frequency f1 (=f2) in the first period was preferably 5 to 20 kHz, and more preferably 8 to 15 kHz.

Fog was lowered when the f1 was lower than 5 kHz like in the condition 22, and the following property of the toner to a change of the potential was decreased to decrease the image density and lower dot reproducibility when the f1 exceeded 20 kHz like in the condition 17.

Comparing the conditions 4, 11 to 14, and 28, Vpp(1) was preferably 3 kV or less. When Vpp(1) was lower than 1 kV like in the condition 14, the image density was insufficient and there was no merit to utilize the invention. The image density was increased when Vpp(1) was increased, however, when exceeding 3 kV, a leak current is generated between the photoreceptor 51 and the development sleeve 9 so that a spot-like white void was easily generated.

Second Embodiment

Next, a second embodiment of the invention will be described. The waveform of the developing bias voltage in this embodiment is different from the first embodiment.

Figure 8:
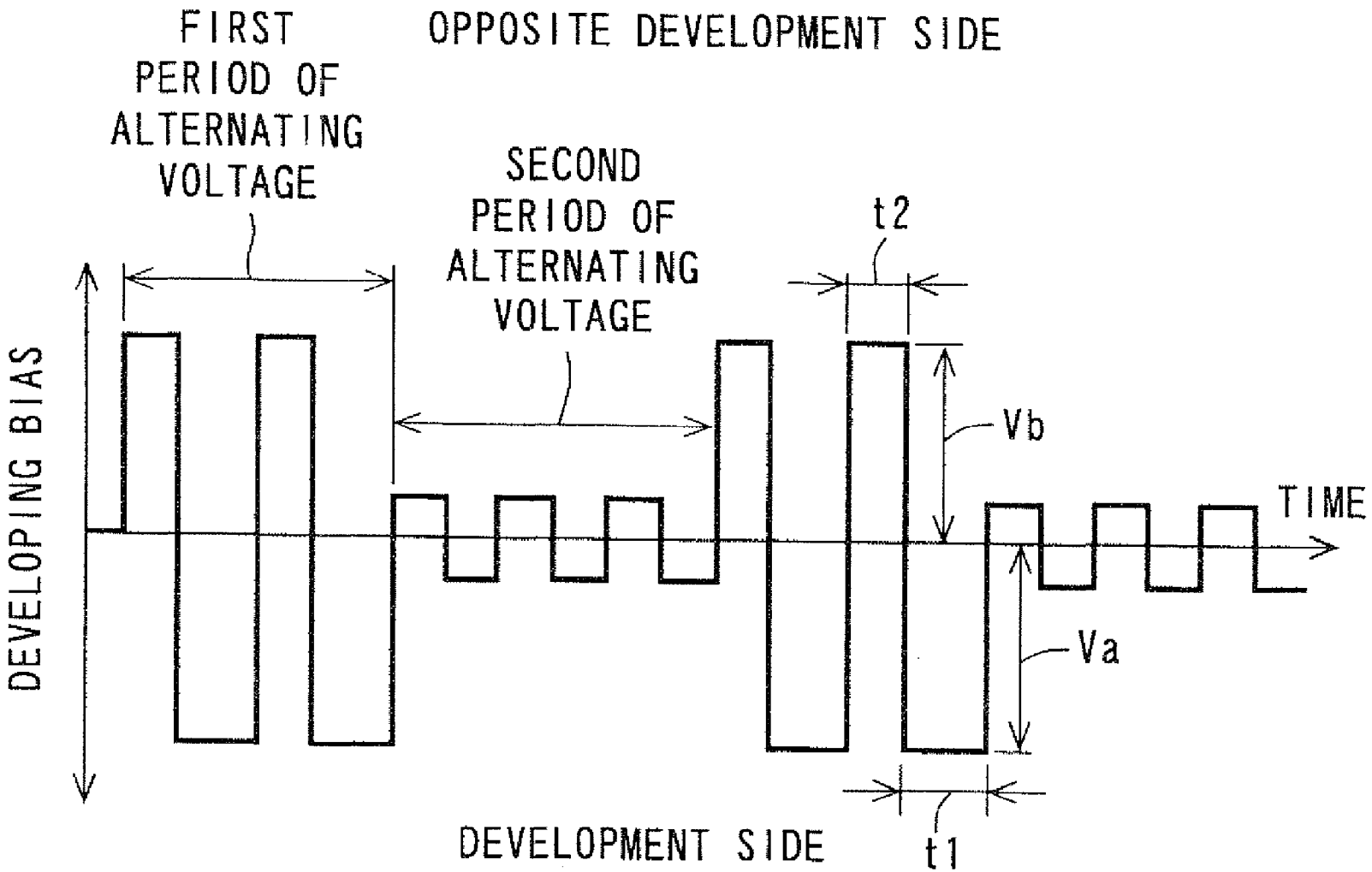
FIG. 8 is a view showing the development bias voltage waveform of the invention.

The bias voltage applying section 110 applies a bias voltage of the waveform as shown in FIG. 8 to the development sleeve 9 of the developing roller 3 as an oscillating bias voltage which is an alternating voltage in which a development-side potential that applies a force to move toner from the developing roller 3 to the photoreceptor 51 and an opposite development-side potential that applies a force to move toner from the photoreceptor 51 to the developing roller 3 alternate with each other periodically.

When a time during which the development-side potential that moves toner from the development sleeve 9 to the photoreceptor 51 is applied is t1 and a time during which the opposite development-side potential that moves toner from the photoreceptor 51 to the development sleeve 9 is applied is t2 in the first period during which Vpp(1) is applied, it is defined as t1=t2 in the first embodiment, but t1 is differentiated from t2 in this embodiment.

A suitable range of t1/(t1+t2)×100(%) is preferably 35 to 70%, and more preferably 40 to 60%. In the case of t1/(t1+t2)×100>50%, fog and the image density are improved, however, the image density and dot reproducibility are lowered as being increased. In the case of t1/(t1+t2)×100<50%, dot reproducibility is improved, however, fog is lowered as being decreased.

To study the second embodiment more specifically, experiments were conducted as follows.

Example 2 was conducted such that Vpp(1) was 1.6 kV, Vpp(2) was 480 V, the frequency f1 in the first period was 10 kHz, the frequency f2 in the second period was 2 kHz, the periodic number in the first period was twice, the periodic number in the second period was three times, and t1/(t1+t2)×100=60%. Note that, the following Table 2 shows Example 2 as the condition 30.

The waveform of the developing bias was fixed to the waveform shown in FIG. 8 and parameters of Va, Vb, and t1/(t1+t2)×100 were changed variously to evaluate the image density, dot reproducibility, and fog in the same manner as the first embodiment. Note that, it was defined as |Va|×t1=|Vb|×t2 and Vpp=|Va|+|Vb|, and Va and Vb were changed so that Vpp and an average potential were constant.

As to the evaluation results, Table 2 shows comprehensive results compared to the result of Comparative example 1. Compared to Comparative example 1, the exceeding result was represented by "Good", the equivalent result was represented by "Not bad" and the lower result was represented by "Poor". In addition, the result exceeding the condition 5 in the first embodiment was represented by "Excellent".

TABLE 2

| Conditions | Vpp(1) [V] | Vpp(2) [V] | f1(=f2) [kHz] | ft [kHz] | First periodic number | Second periodic number | \|Va\| | \|Vb\| | t1/(t1 + t2) | Image density | Dot reproducibility | Fog |
|---|---|---|---|---|---|---|---|---|---|---|---|---|
| Condition 5 | 1600 | 480 | 10 | 2.0 | 2 | 3 | 860 | 800 | 50% | Good | Good | Good |
| Condition 30 | 1600 | 480 | 10 | 2.0 | 2 | 3 | 640 | 960 | 60% | Good | Good | Excellent |
| Condition 31 | 1600 | 480 | 10 | 2.0 | 2 | 3 | 560 | 1040 | 65% | Good | Good | Excellent |
| Condition 32 | 1600 | 480 | 10 | 2.0 | 2 | 3 | 480 | 1120 | 70% | Not bad | Not bad | Excellent |
| Condition 33 | 1600 | 480 | 10 | 2.0 | 2 | 3 | 320 | 1280 | 80% | Poor | Not bad | Excellent |
| Condition 34 | 1600 | 480 | 10 | 2.0 | 2 | 3 | 960 | 640 | 40% | Good | Excellent | Good |

TABLE 2-continued

| Conditions | Vpp(1) [V] | Vpp(2) [V] | f1(=f2) [kHz] | ft [kHz] | First periodic number | Second periodic number | \|Va\| | \|Vb\| | t1/(t1 + t2) | Image density | Dot reproducibility | Fog |
|---|---|---|---|---|---|---|---|---|---|---|---|---|
| Condition 35 | 1600 | 480 | 10 | 2.0 | 2 | 3 | 1040 | 560 | 35% | Good | Excellent | Not bad |
| Condition 36 | 1600 | 480 | 10 | 2.0 | 2 | 3 | 1120 | 480 | 30% | Good | Excellent | Poor |

In the case of t1/(t1+t2)×100>50% like in the conditions 30 to 32, fog and the image density were improved, however, the image density and dot reproducibility were lowered as being increased, and the result of the image density was "Poor" in the case of 80% like in the condition 33.

In the case of t1/(t1+t2)×100<50% like in the conditions 34 and 35, dot reproducibility was improved, however, fog was lowered as being decreased, and the result of fog was "Poor" in the case of 30% like in the condition 36.

Note that, the time t1 for applying the development-side potential and the time t2 for applying the opposite development-side potential were the same in the second period of the second embodiment, but may be different similarly to the first period.

Note that, although description has been given for the case of using two-component development in the first and second embodiments, the invention relates to a developing bias that moves toner, and the similar effect is also obtained in one-component developer without limitation to two-component development. Moreover, the similar effect is also obtained in a contact developing method in which development is performed with developer being in contact with the photoreceptor and a non-contact developing method in which development is performed with developer being not contact with the photoreceptor.

Third Embodiment

In the first embodiment and the second embodiment, the magnetic pole members inside the magnet roller 8 are arranged at the same position and an N-pole serving as a main pole is arranged at an opposed position at which the photoreceptor 51 is most adjacent to the developing roller 3. Against this, in a third embodiment, the magnetic pole is not arranged at the opposed position and magnetic members are arranged so that the opposed position is in a middle of the arrangement of two magnetic poles. Thereby, it is configured such that a horizontal magnetic field is generated at the opposed position by the two magnetic poles close to the opposed position.

Figure 12:
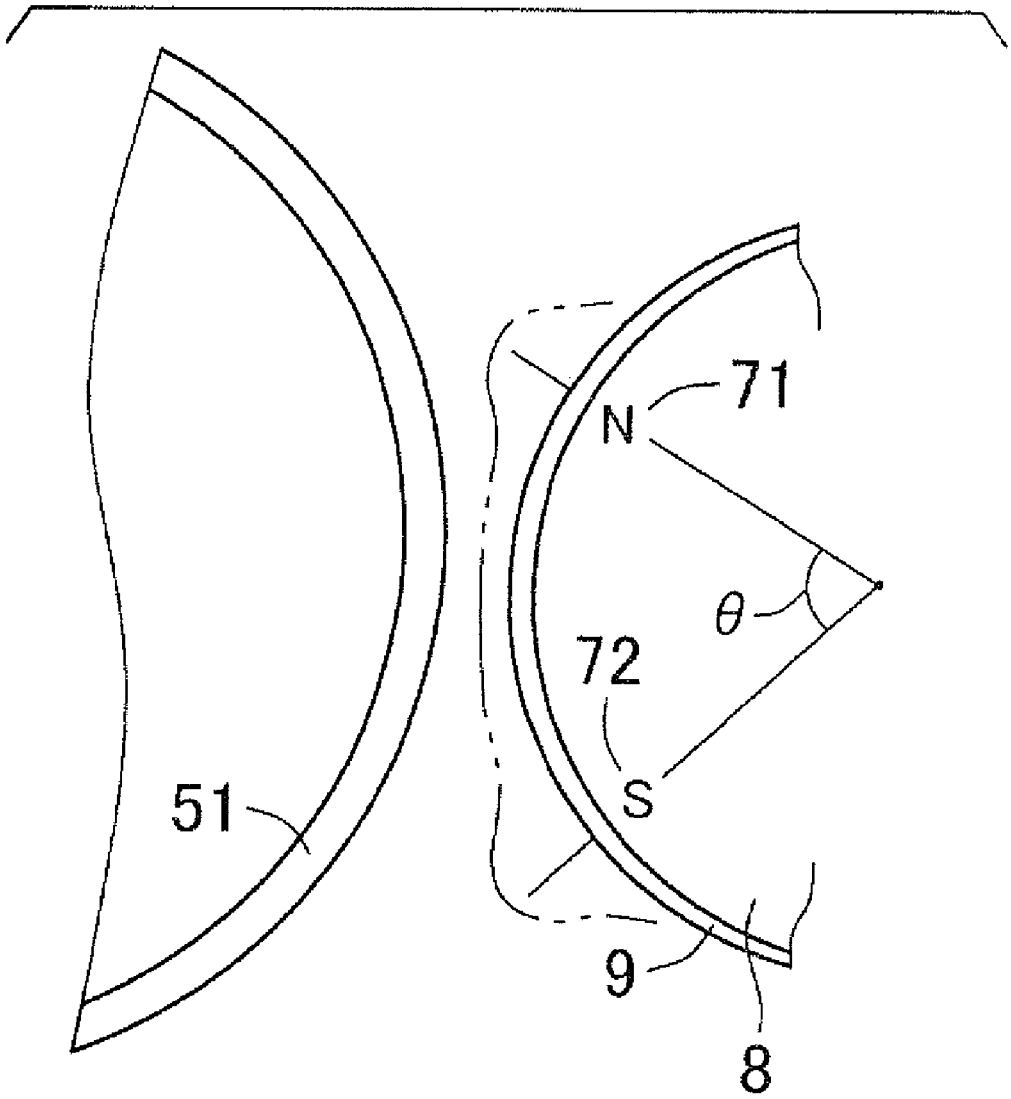
FIG. 12 is a schematic view showing arrangement of magnetic poles in a developing area and a state of magnetic chains.

FIG. 12 is a schematic view showing arrangement of magnetic poles in a developing area and a state of magnetic chains.

In this embodiment, the magnetic sole is not arranged at an opposed position at which the photoreceptor 51 is most adjacent to the developing roller 3 and two magnetic poles of an N-pole 71 and an S-pole 72 are arranged across the opposed position in the magnet roller 8.

For example, a magnetic flux density at a peak position of magnetic flux generated by the N-pole 71 is 1100 mT, a magnetic flux density at a peak position of magnetic flux generated by the S-pole 72 is 800 mT, and an angle θ formed by a segment connecting the peak position of magnetic flux of the N-pole 71 and a center of the magnet roller 8 and a segment connecting the peak position of magnetic flux of the S-pole 72 and a center of the magnet roller 8 is about 80° when viewed from a direction of a central axis of the magnet roller 8. The N-pole 71 and the S-pole 72 are arranged so that a bisector that bisects the angle passes through the opposed position.

The magnetic chains of the magnetic brush increases at peak positions of magnetic flux by the N-pole 71 and the S-pole 72, and the magnetic chains are laid in the horizontal direction to decrease the magnetic chains as it is far from the Peak positions. By arranging the N-pole 71 and the S-pole 72 as described above, the magnetic chains also gradually decrease from the peak position of the N-pole 71 toward the opposed position and the magnetic chains gradually decrease from the peak position of the S-pole 72 toward the opposed position. With such arrangement, the face of the magnetic brush formed on the surface of the development sleeve 9, which is opposed to the photoreceptor 51, is suppressed to be low near the developing area at the opposed position. Such a magnetic brush secures a gap between the surface of the photoreceptor 51 so that unevenness in an image due to scraping of the magnetic brush in development is able to be prevented. Note that, the closest distance between the surface of the development sleeve 9 and the surface of the photoreceptor 51 is 0.5 mm.

In this embodiment, the bias voltage of the waveform as shown in FIG. 3 is applied to the development sleeve 9 of the developing roller 3.

As shown in FIG. 3, the bias voltage waveform is repeatedly applied in which, subsequent to the first period in which a peak-to-peak voltage of the bias voltage of this embodiment is large, the second period in which Vpp is small is provided. Further, when the frequency f1 in the first period and the frequency f2 in the second period have a relation of f1=f2, and when the time during which the development-side potential that moves toner from the development sleeve 9 to the photoreceptor 51 is applied is t1 and the time during which the opposite development-side potential that moves toner from the photoreceptor 51 to the development sleeve 9 is applied is t2, t1=t2 is satisfied.

To study the third embodiment more specifically, experiments were conducted as follows.

The bias waveform applied in Example 3 was such that Vpp(1) was 2.0 kV or 2.5 kV, Vpp(2) was 560 V, the frequency f1 in the first period was 10 kHz, the frequency f2 in the second period was 2 kHz, the periodic number in the first period was twice, and the periodic number in the second period was three times.

In addition, in Comparative example 3, the bias voltage of the waveform shown in FIG. 9 was applied with Duty 50%, Vpp=1000 V to 2000 V, and the frequency of 10 kHz.

Evaluation of graininess was carried out for Example 3 and Comparative example 3.

Used for the evaluation of graininess was a macro printing evaluating device manufactured by Oji Scientific Instruments and the evaluation of graininess represented by the following formula was carried out.

The evaluation was carried out using a graininess scale (GS). The graininess was better as the graininess scale was smaller.

$$\text{Graininess scale GS}=\exp(-1.8D)\int\sqrt{WS(u)}VTF(u)du$$

wherein:

D: Optical density u: Space frequency

WS(u): Wiener spectrum

VTF(u): Visual approximation function of space frequency property

That is, the graininess scale GS was calculated by converting a color space of RGB data of an image formed on a printed matter into a density value or L*a*b* data, then performing two-dimensional FFT (Fast Fourier Transformation), and multiplying power spectrum by a VTF function, which is integrated and multiplied by a density term.

The graininess scale GS is described in detail in the Literature "Noise Perception in Electrophotography" by Roger P. Dooley and Rodney Shaw, Journal of Applied Photographic Engineering Volume 5, Number 4. Fall 1979.

Figure 13:
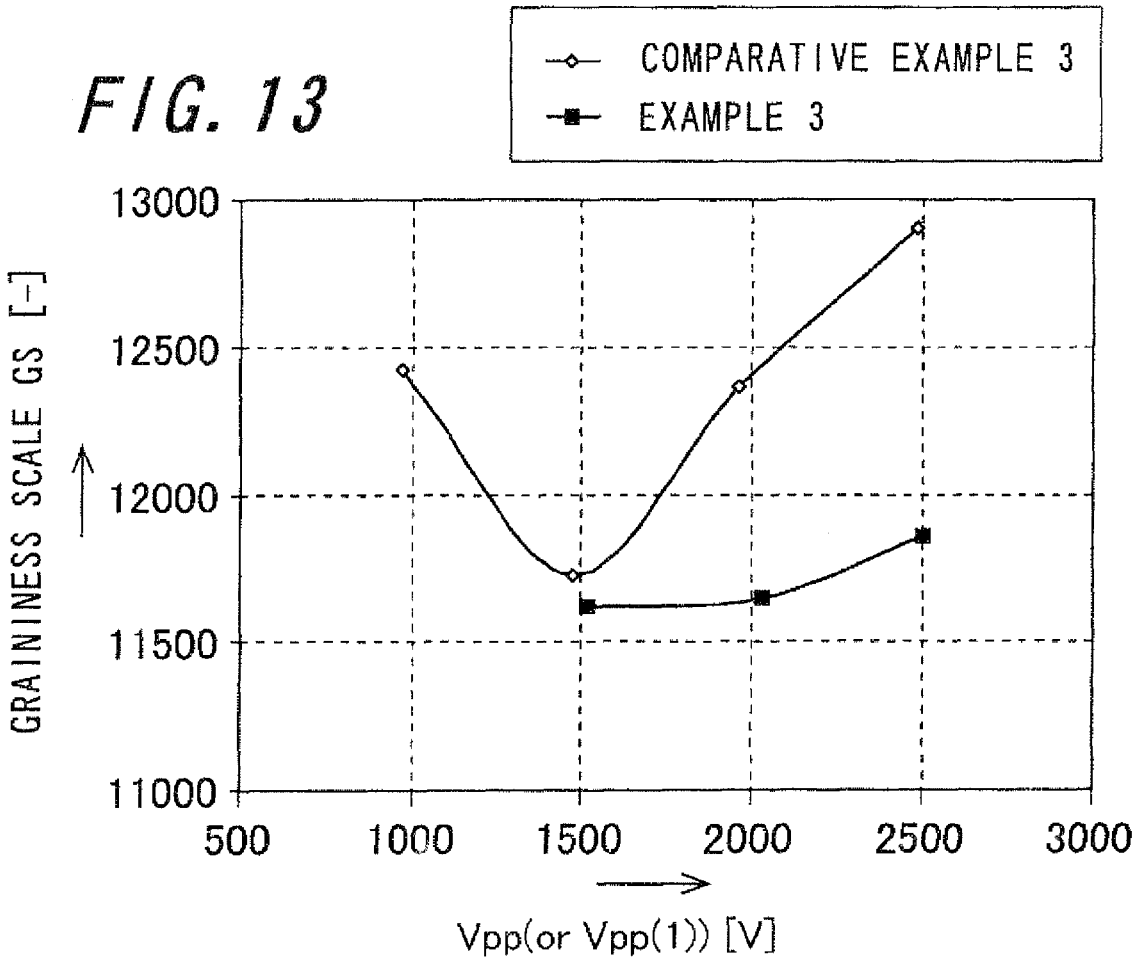
FIG. 13 is a view showing results of the graininess evaluation in Example 3 and Comparative example 3.

FIG. 13 is a view showing results of the graininess evaluation in Example 3 and Comparative example 3. The peak-to-peak voltage (V) is taken along the horizontal axis and the graininess scale GS (–) is taken along the vertical axis.

In Comparative example 3, the value of the graininess scale GS was the smallest, that is, the graininess was most excellent under the condition that Vpp was 1500 V, and the graininess was suddenly deteriorated when Vpp was further increased from 1500 V to secure the image density. On the other hand, in Example 3, the graininess was not deteriorated under any conditions of Vpp(1)=1500 V, Vpp(1)=2000 V, and Vpp(1)=2500 V, and the graininess was improved compared to the conditions of Vpp=1500 V, 2000 V, and 2500 V in Comparative example 3.

It was considered such that, as has been described in the first embodiment, the toner having flown to the photoreceptor 51 in the first period during which a large Vpp(1) was applied was gradually moved to a dot latent image to form stable dots and the face of the magnetic brush opposed to the photoreceptor 51 was suppressed to be low so that the magnetic brush was not brought into contact with the photoreceptor 51, resulting in improvement of the graininess.

In addition, the stably formed dots show in other words that the toner returned from the photoreceptor 51 to the development sleeve 9 was reduced compared to Comparative example. Accordingly, the invention is suitable for a so-called image-on-image development system in which a plurality of colors of toner images are overlaid and developed, which are collectively transferred to a transfer-subjected material.

A plurality of kinds of toners are mixed to generate color mixture when there is only the first period with a large Vpp, however, by providing the second period with a small Vpp, it is possible to suppress the color mixture.

Figure 14A:
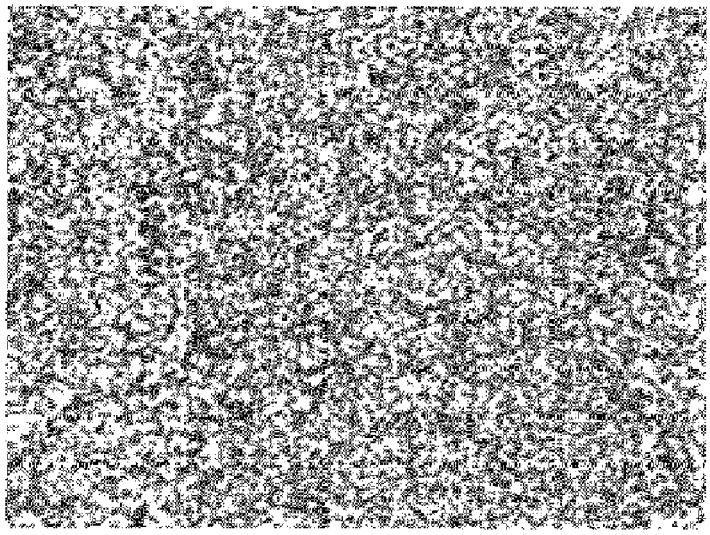
FIGS. 14A and 14B are views showing a toner image developed on the surface of the photoreceptor when a solid image is developed by Example 3 and a toner image developed on the surface of the photoreceptor in the case of Comparative example 1.
Figure 14B:
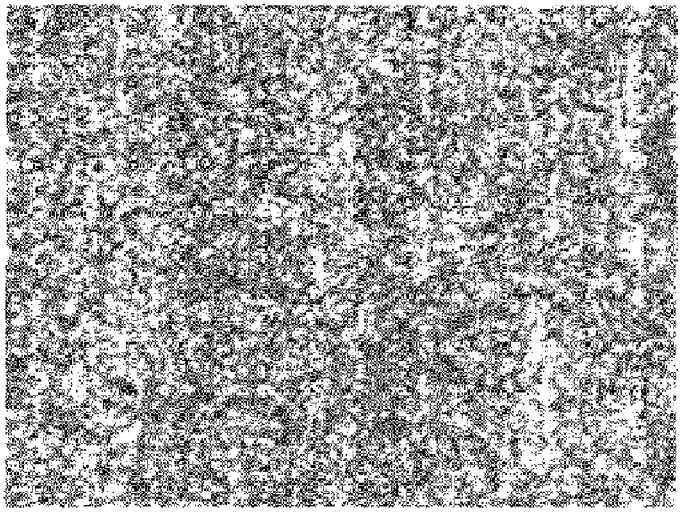

FIGS. 14A and 14B are views showing a toner image developed on the surface of the photoreceptor when a sold image is developed by Example 3 and a toner image developed on the surface of the photoreceptor in the case of Comparative example 1. FIG. 14A shows the case of Example 3 and the FIG. 14B shows the case of Comparative example 1.

It was found that, in a case where contact development was performed in Comparative example 1, scraping streaks were generated and uniformity in the solid image was not good due to increased magnetic chains of the magnetic brush, while in the case of Example 3, no scraping streaks were generated and uniformity in the solid image was improved. Note that, the comparison was conducted under the condition that the toner adhering quantity was smaller on the surface of the photoreceptor (about 0.25 mg/cm$^2$) so that the developed toner image was easily observed.

Moreover, in Example 3, toners that have shape factors SF-1 of 140 to 160 and SF-2 of 130 to 150 was used. The graininess scale GS at this time was 11650 under Vpp(1)=2000V.

Further, when toners whose shape factors SF-1 and SF-2 were changed to 130 to 140 and 120 to 130, respectively, were used, by applying sphering processing to the toners, the graininess scale was 10500 under the same development condition, which showed that the graininess was improved by changing the shape factors SF-1 and SF-2.

Accordingly, by using toners that have small toner shape factors SF-1 and SF-2, that is, that have a spherical shape with less unevenness on the surface, the graininess was improved.

Figure 15:
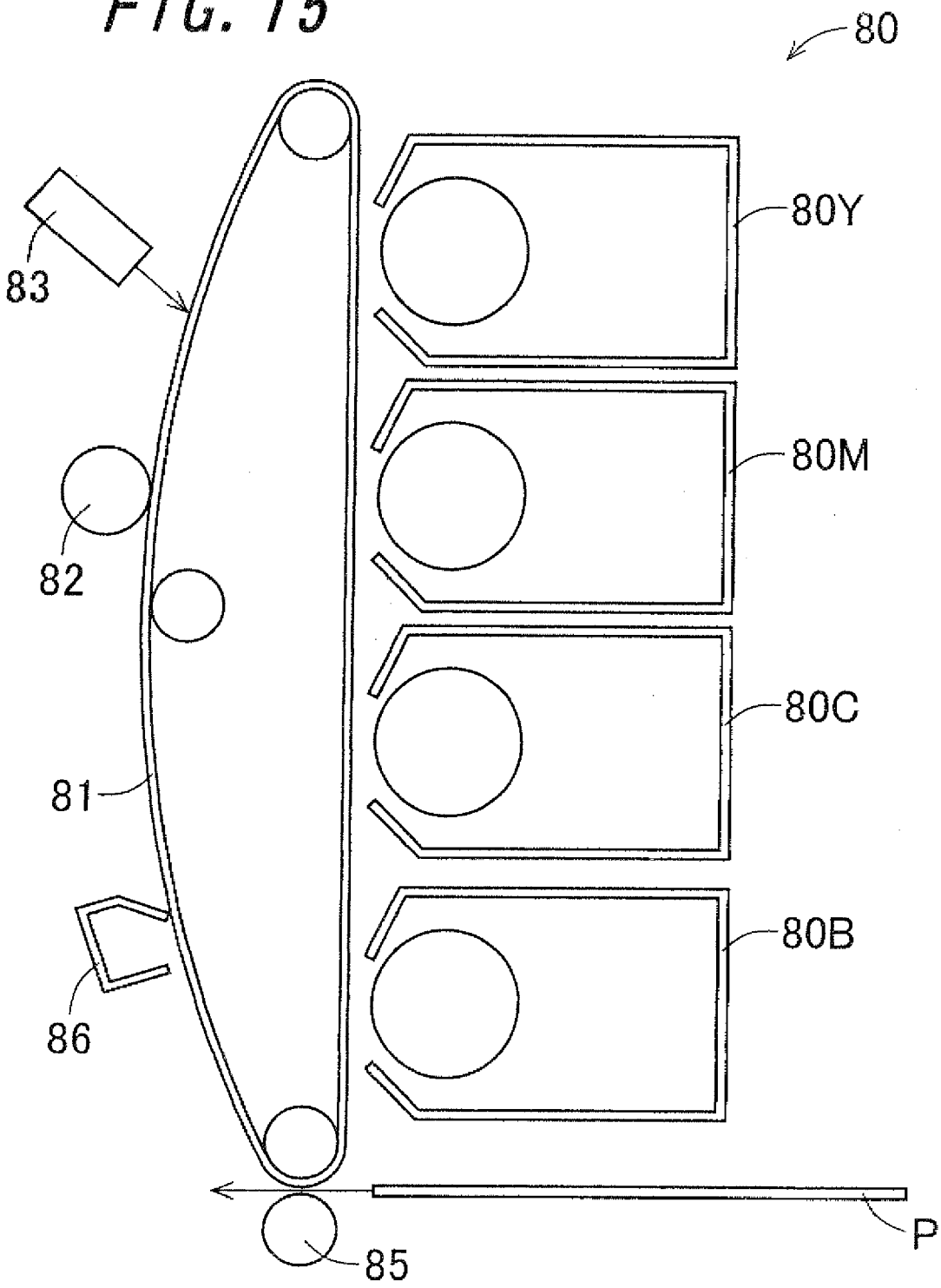
FIG. 15 is a schematic view showing a configuration of an image forming station section using an image-on-image development system.

FIG. 15 is a schematic view showing a configuration of an image forming station section 80 using an image-on-image development system.

The image forming station section 80 is comprised of four developing devices of a yellow image developing device 80Y, a magenta image developing device 80M, a cyan image developing device 80C and a black image developing device 80B, and a photoreceptor belt 81.

Arranged around the photoreceptor belt 81 are a charging device 82, an exposure device 83, a transfer device 85, and a cleaning device 86 in a circumferential direction.

The developing devices 80Y, 80M, 80C, and 80B are substantially the same in the configuration and develop an electrostatic latent image formed on the photoreceptor belt 81 using yellow, magenta, cyan, and black toner.

The charging device 82 charges the surface of the photoreceptor belt 81 uniformly and the exposure device 83 forms an electrostatic latent image on the surface of the photoreceptor belt 81. Toner images of respective colors are overlaid and developed by the yellow image developing device 80Y, the magenta image developing device 80M, the cyan image developing device 80C, and the black image developing device 80B in this order with respect to the formed electrostatic latent image, and the overlaid toner images are collectively transferred to a transfer subjected material P by the transfer device 85.

In the invention, the bias voltage of the waveform as shown in FIG. 3 is applied when developing devices 80Y, 80M, 80C, and 80B perform development on the photoreceptor belt 81.

Although the configuration using the photoreceptor belt has been shown in FIG. 15, a drum-type photoreceptor may be used without limitation to the above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an electrostatic latent image bearing member on which an electrostatic latent image is to be formed; and a developing device that has a developer bearing member and develops the electrostatic latent image formed on the electrostatic latent image bearing member with a toner by applying an alternating voltage superimposed on a DC voltage, to the developer bearing member, the alternating voltage to be applied having an alternating voltage waveform in which a development-side potential to move a toner from the developer bearing member to the electrostatic latent image bearing member and an opposite development-side potential to move a toner from the electrostatic latent image bearing member to the developer bearing member alternate with each other, and in the alternating voltage, a first period during which a first peak-to-peak voltage being applied and a second period during which a second peak-to-peak voltage lower than the first peak-to-peak voltage being applied are alternately repeated and a frequency f1 of the alternating voltage in the first period and a frequency f2 of the alternating voltage fin the second period have a relation of f1=f2.

2. The image forming apparatus of claim 1, wherein a potential that is applied finally in the first period is the development-side potential in the alternating voltage.

3. The image forming apparatus of claim 1, wherein a periodic number included in the first period is 2 or 3 in the alternating voltage.

4. The image forming apparatus of claim 1, wherein a periodic number included in the second period is 2 or more in the alternating voltage.

5. The image forming apparatus of claim 1, wherein the following expression is satisfied in the alternating voltage:

$$0.1 \leqq Vpp(2)/Vpp(1) \leqq 0.5,$$

where Vpp(1) denotes a peak-to-peak voltage in the first period and Vpp(2) denotes a peak-to-peak voltage In the second period.

6. The image forming apparatus of claim 1, wherein a frequency f1 in the first period is 5 kHz or more and 25 kHz or less in the alternating voltage.

7. The image forming apparatus of claim 1, wherein the peak-to-peak voltage in the first period Vpp(1) satisfies the following expression in the alternating voltage:

$$1\ kV \leqq Vpp(1) \leqq 3\ kV.$$

8. The image forming apparatus of claim 1, wherein t1 and t2 are differentiated at least in the first period of the alternating voltage, where t1 denotes a time during which the development-side potential is applied and t2 denotes a time during which the opposite development-side potential is applied.

9. The image forming apparatus of claim 8, wherein t1 and t2 satisfy the following expression at least in the first period of alternating voltage:

$$0.35 < t1/(t1+t2) \leqq 0.70.$$

10. The image forming apparatus of claim 1, wherein a two-component developer including a toner and a carrier is used as a developer.

11. The image forming apparatus of claim 1, wherein the developer bearing member includes a magnet roller that has a plurality of magnetic pole members arranged along a circumferential direction and a development sleeve fitted onto the magnet roller so as to rotate freely, and the magnet roller has the magnetic pole members arranged so that an opposed position at which the electrostatic latent image bearing member and the developer bearing member are most adjacent to each other is in a middle of two-magnetic pole members.

12. The image forming apparatus of claim 11 wherein the developing device is configured so that at least two kinds of toners are used for a single electrostatic latent image bearing member.

13. The image forming apparatus of claim 1, wherein the developing device carries out development using a toner whose shape factor SF-1 is 130 to 140 and whose shape factor SF-2 is 120 to 130.

* * * * *